US005298376A

United States Patent [19]

Szajewski et al.

[11] Patent Number: 5,298,376

[45] Date of Patent: * Mar. 29, 1994

[54] PHOTOGRAPHIC SILVER HALIDE MATERIAL WITH IMPROVED COLOR SATURATION

[75] Inventors: Richard P. Szajewski; Allan F. Sowinski, both of Rochester, N.Y.

[73] Assignee: Eastman Kodak Company, Rochester, N.Y.

[ * ] Notice: The portion of the term of this patent subsequent to Oct. 19, 2010 has been disclaimed.

[21] Appl. No.: 771,016

[22] Filed: Oct. 1, 1991

[51] Int. Cl.[5] ..... G03C 1/46

[52] U.S. Cl. ..... 430/505; 430/544; 430/957; 430/214; 430/215; 430/536; 430/545; 430/382

[58] Field of Search ..... 430/544, 215, 214, 505, 430/957, 536, 545, 382

[56] References Cited

U.S. PATENT DOCUMENTS

| | | | |
|---|---|---|---|
| 2,555,646 | 6/1951 | Jones | 524/555 |
| 3,455,686 | 7/1969 | Farney et al. | 430/215 |
| 3,576,628 | 8/1971 | Beavers | 430/244 |
| 3,706,557 | 12/1972 | Arond | 430/215 |
| 3,765,893 | 10/1973 | Lohmer | 430/503 |
| 3,819,379 | 6/1974 | Ohyama | 430/505 |
| 3,867,152 | 2/1975 | Priem et al. | 430/420 |
| 3,888,669 | 6/1975 | Cardone | 430/214 |
| 3,984,245 | 10/1976 | Hirose | 430/505 |
| 4,055,429 | 10/1977 | Holmes et al. | 430/444 |
| 4,088,499 | 5/1978 | Brust et al. | 430/215 |
| 4,214,047 | 7/1980 | Chen | 430/448 |
| 4,317,892 | 3/1982 | Abel | 252/194 |
| 4,396,706 | 8/1983 | Ishii et al. | 430/403 |
| 4,440,848 | 4/1984 | Bailey et al. | 430/215 |
| 4,504,569 | 3/1985 | Abel et al. | 430/214 |
| 4,575,481 | 3/1986 | Takahashi et al. | 430/215 |
| 4,722,885 | 2/1988 | Yokoyama et al. | 430/215 |
| 4,822,727 | 4/1989 | Ishigaki et al. | 430/536 |
| 4,865,946 | 9/1989 | Bowman et al. | 430/215 |

FOREIGN PATENT DOCUMENTS

| | | |
|---|---|---|
| 0358187 | 9/1989 | European Pat. Off. . |
| 92116371 | 1/1993 | European Pat. Off. . |
| 2331817 | 10/1977 | France . |
| 61236542 | 11/1978 | Japan . |
| 58-166341 | 10/1983 | Japan . |
| 1466600 | 3/1977 | United Kingdom . |

OTHER PUBLICATIONS

Research Disclosure 19551, Jul. 1980, Disclosed anonymously, pp. 301-310.

*Primary Examiner*—Charles L. Bowers, Jr.
*Assistant Examiner*—Geraldine Letscher
*Attorney, Agent, or Firm*—Sarah Meeks Roberts

[57] ABSTRACT

This invention provides a color silver halide photographic element having improved color saturation and a method of developing the photographic element. The photographic element comprises at least a first and a second silver halide emulsion layer each sensitized to a different region of the spectrum with at least one of the emulsion layers being in reactive association with a DIR compound which can release an anionic development inhibitor. The photographic element further contains a barrier layer containing an anionic latex polymer such that the barrier layer is positioned further from the support than the first and second silver halide emulsion layers.

12 Claims, No Drawings

PHOTOGRAPHIC SILVER HALIDE MATERIAL WITH IMPROVED COLOR SATURATION

This invention is related to copending, commonly assigned U.S. application Ser. No. 720,360 and copending, commonly assigned U.S. application Ser. No. 720,359 both filed Jun. 25, 1991. It is also related to copending, commonly assigned U.S. application Ser. No. 07/771,030, Pearce et al. entitled Development Inhibitor Reflector Layers, filed concurrently.

FIELD OF THE INVENTION

This invention relates to a silver halide color photographic material comprising a compound capable of releasing a development inhibitor moiety during photographic processing and an anionic polymer latex barrier layer. The specific placement of the barrier layer in the photographic material can control and improve the color saturation of the finished product.

BACKGROUND OF THE INVENTION

Silver halide color photographic recording materials typically comprise a support onto which are applied distinct layers which vary in composition and function. Some of these layers include silver halide emulsions sensitized to a specific spectral region. Generally there are at least three sensitized silver halide layers in a color photographic material, a cyan dye layer, a magenta dye layer and a yellow dye layer. Additionally, these silver halide color photographic materials will often employ two, three or more layers which vary in the degree of sensitivity to a specific spectral region, for example a fast cyan layer and a slow cyan layer.

Other layers are incorporated for ancillary purposes which include, but are not limited to, isolating the light sensitive silver halide layers from one another and protecting the light sensitive silver halide emulsions from handling and environmental damage. Many arrangements and combinations of such individual layers are known in the art.

Various compounds, particularly couplers, that are capable of releasing a development inhibitor during photographic processing are known in the photographic art. Examples of such compounds are described in U.S. Pat. Nos. 3,227,554; 3,384,657; 3,379,529; 3,615,506; 3,617,291; 3,620,746; 3,701,783; 3,733,201; 4,049,455; 4,095,984; 4,248,962; 4,409,323; and 4,962,018, as well as in "Development-Inhibitor-Releasing (DIR) Couplers in Color Photography", C. R. Barr, J. R. Thirtle and P. W. Vittum in *Photographic Science and Engineering,* vol. 13, page 174 (1969).

Development inhibitor releasing compounds, known as DIR compounds, are used in silver halide color photographic materials to influence many photographic properties. These uses include but are not limited to the control of intralayer developability, i.e. the control of the gamma of a photographic layer with which they are reactively associated and the control of interlayer interimage effects, i.e. the control of the developability or gamma of other photographic layers . They can also be used to control granularity and sharpness.

One use of development inhibitors is to affect the color saturation of a color image. The color saturation of an object is the colorfulness of that object as judged in proportion to the brightness of an otherwise similar gray object. In a like vein, the color saturation attained in a photographic image of an object is related to the differences between the color densities formed in photographically reproducing that object and the color densities formed in photographically reproducing an otherwise similar (as to brightness) gray object. These differences in color density formation resulting from differences in the color of an object can be augmented by several means. One of these means is by application of the Interlayer Interimage Effect (IIE) as induced by the imagewise release of a development inhibitor from a DIR compound during development of the photographic material.

In practice, high levels of color saturation can be attained when a color photographic material is designed such that development inhibitors released as a function of development in one color record have a large development inhibiting effect on development in the other color records. By this expedient, the color densities formed in photographically reproducing a colored object are caused to be greatly different from the color densities formed in photographically reproducing an otherwise similar (as to brightness) gray object. For example, the red density produced in a negative image of a red object will be greater than the red density produced in a negative image of an otherwise similar (as to brightness) gray object when development inhibitors released as a function of development in a green-light or blue-light sensitive layer (layers rendered developable by exposure to the gray object but not by exposure to the red object) have a large development inhibiting effect on the red-light sensitive layer. However, often during processing the development inhibitors diffuse out of the photographic element before they can fully enhance color saturation thus leaving a finished product which is dull and unappealling. One method of increasing color saturation is to retain the development inhibitor within the photographic element.

It is known to utilize scavenger layers for released development inhibitors to prevent the diffusion of such inhibitors. Such scavenger layers include the use of Lippmann emulsions in layers above, between or below image forming emulsion layers to inhibit the migration of development inhibitor either between layers or from the element to the developing solution other inhibitor adsorbing layers are described in U.S. Pat. Nos. 3,984,245 and 4,055,429. Polymers which mordant or scavenge development inhibitor, however, remove it from the system and the photographic material would require a higher concentration of DIR compound to provide the desired color saturation.

A need still exists for a color photographic silver halide element showing a high degree of color saturation and a means of conveniently adjusting the degree of color saturation provided by such an element. Use of DIR compounds alone has not proven adequate to fully meet the needs of users of such color recording materials while the use of scavenging or mordanting polymers or other mordanting species in combination with DIR compounds does not adequately address this need.

SUMMARY OF THE INVENTION

This invention provides a solution to this problem by providing a color photographic element having a stragically placed barrier layer containing a latex anionic polymer which reflects released development inhibitors in a manner which enhances the interimage effects of the development inhibitors. The photographic element of this invention contains a first and a second silver halide emulsion layer each sensitized to a different region of the spectrum, at least one of which is in reactive association with a DIR compound. The photographic element further contains a barrier layer comprising a latex anionic polymer, the barrier layer being positioned further from the support of the photographic element than the first and second silver halide emulsion layers. The polymer contained in the barrier layer reflects the anionic development inhibitors released by the DIR compounds back into the photographic element thereby enhancing the color saturation activity of the development inhibitors. This invention also provides a method of processing the photographic element containing the barrier layer.

In one embodiment the latex polymer is derived from ethylenically unsaturated monomers. Preferably the polymer is comprised of repeating units derived from non-polar acrylate monomers and polar vinyl monomers having anionic pendant groups with at least 1% by weight of the repeating units containing an anionic pendant group. More preferably 1 to 20% of the repeating units contain anionic pendant groups and most preferably 4–10% of the repeating units contain anionic groups. The preferred monomers are discussed in greater detail hereafter.

DETAILED DESCRIPTION

The photographic materials of this invention are multicolor materials. The multicolor materials may contain dye image-forming elements sensitive to each of the three primary regions of the spectrum. In some cases the multicolor material may contain elements sensitive to other regions of the spectrum e.g. infrared. Each element can be comprised of a single emulsion layer or multiple emulsion layers sensitive to a given region of the spectrum. The layers of the material, including the layers of the image-forming elements, can be arranged in various orders as known in the art.

The multicolor photographic material will generally comprise a support bearing a cyan dye image-forming element comprising at least one red-sensitive silver halide emulsion layer having associated therewith at least one cyan dye-forming coupler, a magenta dye image forming element comprising at least one green-sensitive silver halide emulsion layer having at least one magenta dye-forming coupler and a yellow dye image-forming element comprising at least one blue-sensitive silver halide emulsion layer having associated therewith at least one yellow dye-forming coupler. However, this invention is not limited to this configuration and can be utilized with any color photographic element providing it has at least two silver halide emulsion layers, each layer sensitized to a different region of the spectrum. In some instances it may be advantageous to employ other pairings of silver halide emulsion sensitivity and dye image-forming couplers, as in the pairing of an infrared sensitized silver halide emulsion with a magenta dye-forming coupler or in the pairing of a blue-green sensitized emulsion with a coupler enabling minus-cyan dye formation.

The layers of the material above the support can have a total thickness between about 1 and 50 microns and preferrably between about 5 and 30 microns. The total silver content of the material can take any value but is preferrably between about 1 and 15 grams per square meter.

The polymers of this invention are anionic latex polymers. Polymeric organic materials may be classified as solution polymers or as polymer latexes. The solution polymers are prepared by solution polymerization followed by dispersion of the polymer in water by addition of the organic solution to water containing a surfactant. The resultant solution can be relatively homogeneous in composition and properties. Polymer latexes are prepared by latex polymerization. On addition of water a stable heterogeneous dispersion of a polymeric substance in an essentially aqueous environment is formed. The terms homogeneous and heterogeneous are naturally relative and are used here in relation to the degree of heterogeneity commonly introduced into photographic materials on the incorporation of silver halide crystals and coupler dispersions for example. This distinction between polymer types and these methods of preparation are described in Ponticello, et al. U.S. Pat. No. 4,689,359 issued August 1987, at column 2 line 50 and following, and in *Worthington's Dictionary of Plastic*, page 184-ff and 292, published by Technomic Publishing Company, Lancaster, Pa., 1978 both hereby incorporated by reference.

Preferably the polymers are comprised of repeating units derived from ethylenically unsaturated monomers with at least 1% by weight of the repeating units containing an anionic pendant group. More preferably 1% to 20% by weight of the repeating units contain anionic pendant groups and most preferrably 4% to 8% by weight of the repeating units contain anionic pendant groups. Preferred latex polymers are acrylic polymer latexes because of their compatability with most conventional photographic systems.

A more preferred polymer is comprised of repeating units derived from non-polar acrylate or methacrylate monomers and repeating units derived from vinyl monomers containing anionic pendant groups. These polymers have the formula $-(A)_m-(B)_n-$ wherein A is a repeating unit derived from a non-polar acrylate monomer, m is 1% to 99 mole %, B is a repeating unit derived from a vinyl monomer containing an anionic pendant group and n is 1% to 99 mole %. The non-polar acrylate monomers are preferably acrylate esters. It is generally preferred to select individual repeating units of the polymer, including each acrylate ester or other optional repeating unit present, from those containing up to about 21 carbon atoms.

In a preferred form the acrylate ester repeating unit is derived from a monomer satisfying the Formula:

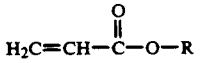

where

R is an ester forming moiety (e.g., the residue of an alcohol or phenol) containing from 2 to 10 carbon atoms, preferably from 2 to 6 carbon atoms, a cycloalkyl group of from 3 to 10 carbon atoms, preferably 5 to 7 carbon atoms; or a mono-oxy, di-oxy, or tri-oxy ether containing from 2 to 10 carbon atoms. Although the foregoing are preferred, it is appreciated that R in the various forms noted can contain up to about 18 carbon atoms when the repeating unit ranges up to 21 carbon atoms, as noted above.

Numerous other forms of the acrylate ester group are, of course, possible, as long as they are compatible with a photographic system.

The acrylate ester monomers set forth in Table I are illustrative of readily available monomers contemplated for use in this invention. Chemical Abstracts Service names and registry numbers are given where available.

Table I

Aa. 2-Propenoic acid, pentyl ester (2998-23-4)
Ab. 2-Propenoic acid, butyl ester (141-32-2)
Ac. 2-Propenoic acid, phenylmethyl ester (2495-35-4)
Ad. 2-Propenoic acid, cyclohexyl ester (3066-71-5)
Ae. 2-Propenoic acid, cyclopentyl ester (1686-13-6)
Af. 2-Propenoic acid, hexadecyl ester (13402-02-3)
Ag. 2-Propenoic acid, 2-methylpropyl ester (106-63-8)
Ah. 2-Propenoic acid, 2-ethylhexyl ester (103-11-7)
Ai. 2-Propenoic acid, 2-(1-ethyl)pentyl ester
Aj. 2-Propenoic acid, 2-(2-ethoxyethoxy)ethyl ester (7328-17-8)
Ak. 2-Propenoic acid, 2-butoxyethyl ester (7251-90-3)
Al. 2-Propenoic acid, 2-(2-methoxyethoxy)ethyl ester (7238-18-9)
Am. 2-Propenoic acid, 2-n-propyl-3-i-propylpropyl ester
An 2-Propenoic acid, octyl ester (2499-59-4)
Ao. 2-Propenoic acid, octadecyl ester (4813-57-4)
Ap 2-Propenoic acid, 2-ethoxyethyl ester (106-74-1)
Aq. 2-Propenoic acid, 2-methoxyethyl ester (3121-61-7)
Ar. 2-Propenoic acid, 2-(methoxyethoxy)ethyl ester (86242-25-3)
As. 2-Propenoic acid, ethyl ester (140-88-5)
At. 2-Propenoic acid, propyl ester (925-60-0)
Au. 2-Propenoic acid, 2-phenoxyethyl ester (48145-04-6)
Av. 2-Propenoic acid, phenyl ester (937-41-7)
Aw. 2-Propenoic acid, 1-methylethyl ester (689-12-3)
Ax. 2-Propenoic acid, hexyl ester (2499-95-8)
Ay. 2-Propenoic acid, 1-methylpropyl ester (2998-08-5)
Az. 2-Propenoic acid, 2,2-dimethylbutyl ester (13141-03-2)

The anionic repeating units can be derived from any convenient vinyl monomer having at least one pendant anionic group. These vinyl monomers can be selected from among those having from 2 to 21 carbon atoms, preferably 3 to 10 carbon atoms. Illustrative of vinyl monomers of this class are those satisfying the following formula $$V-(L)_a-P$$

where

V is a group having a vinyl unsaturation site;
L is a divalent linking group;
a is the integer 1 or 0; and
P is an anionic pendant group.

In one preferred form the highly polar pendant group can be a carboxylic acid or carboxylic acid salt moiety (e.g., an ammonium or alkali metal carboxylate), as shown in the following formula:

$$-\overset{\overset{\displaystyle O}{\|}}{C}-O-M$$

where

M is hydrogen, ammonium, or an alkali metal. The monomers set out in Table II are illustrative of those capable of providing repeating units of this type.

Table II

Ca. 1-Propen-1,2,3-tricarboxylic acid, (499-12-7)
Cb. 2-Propenoic acid (79-10-7)
Cc. 2-Propenoic acid, sodium salt (7446-81-3)
Cd. 2-Chloro-2-propenoic acid (598-79-8)
Ce. 2-Propenoic acid, 2-carboxyethyl ester (24615-84-7)
Cf. 2-Methyl-2-propenoic acid (79-41-4)
Cg. 2-Methyl-2-propenoic acid, lithium salt (13234-23-6)
Ch. Methylenebutanedioic acid (97-65-4)
Ci. 2-Butenedioic acid (110-16-7)
Cj. 2-Methylbutenedioic acid (498-24-8)
Ck. 2-Methylenepentendioic acid (3621-79-2)

More preferred are sulfo or oxysulfo pendant groups of the following formula $$-(O)_b-\overset{\overset{\displaystyle O}{\|}}{\underset{\underset{\displaystyle O}{\|}}{S}}-O-M$$

where

M is as previously defined and
b is zero or one.

The monomers set out in Table III are illustrative of those capable of providing repeating units of this type.

Table III

Sa. 2-Carboethoxyallyl sulfate, sodium salt
Sb. 2-Propenoic acid, ester with 4-hydroxy-1-butanesulfonic acid, sodium salt (13064-32-9)
Sc. 2-Propenoic acid ester with 4-hydroxy-2-butanesulfonic acid, sodium salt (15834-96-5)
Sd. 3-Allyloxy-2-hydroxypropanesulfonic acid, sodium salt
Se. 2-Methyl-2-propenoic acid ester with 3-[tert-butyl(2-hydroxyethyl)amino]propane sulfonic acid (14996-75-9)
Sf. Ethenesulfonic acid, sodium salt (3039-83-6)
Sg. Methylenesuccinic acid, diester with 3-hydroxy-1-propane sulfonic acid, disodium salt (21567-32-8)
Sh. 2-Methyl-2-propenoic acid ester with 2-(sulfooxy) ethyl, sodium salt (45103-52-4)
Si. N-3-Sulfopropyl acrylamide, potassium salt
Sj. 2-Methyl-2-propenoic acid, 2-sulfoethyl ester, (10595-80-9)
Sk. 2-Methyl-2-propenoic acid, 2-sulfoethyl ester, lithium salt (52556-31-7)
Sl. o-Styrene sulfonic acid, ammonium salt
Sm. p-Styrene sulfonic acid, potassium salt (4551-90-0)
Sn. p-Styrene sulfonic acid
So. 4-4-Ethenylbenzenesulfonic acid, sodium salt (2695-37-6)
Sp. 2-Propenoic acid, 3-sulfopropyl ester, sodium salt (15717-25-6)
Sq. m-Sulfomethylstyrene sulfonic acid, potassium salt
Sr. p-Sulfomethylstyrene sulfonic acid, sodium salt
Ss. 2-Methyl-2-propenoic acid, 3-sulfopropyl ester, sodium salt (10548-16-0)
St. 2-Methyl-2-propenoic acid, 3-sulfobutyl ester, sodium salt (64112-63-6)
Su. 2-Methyl-2-propenoic acid, 4-sulfobutyl ester, sodium salt (10548-15-9)
Sv. 2-Methyl-2-propenoic acid, 2-sulfoethyl ester, sodium salt (1804-87-1)
Sw. 2-Methyl-2-[(1-oxo-2-propenyl)amino]-1-propane sulfonic acid (15214-89-8)
sy. 2-Methyl-2-[(1-oxo-2-propenyl)amino]-1-propane sulfonic acid, sodium salt (5165-97-9)

Sz. 2-Methyl-2-[(1-oxo-2-propenyl)amino]-1-propane sulfonic acid, potassium salt (52825-28-2)

Other anionic pendant groups derived from sulfite, phosphite, phosphate, phosphonate, borate, carbonate, nitrite, nitrate, thiosulfate, thiosulfite, thiosulfonate, phenolate, oxime and such may also be advantageously considered.

A group of preferred anionic monomers has the following formula:

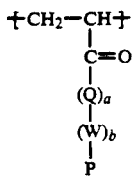

wherein Q is a —NH— or an —O— and W is a straight branched or cyclic alkylene group of 3 to 10 carbon atoms and a and b are one or zero.

In preparing hydrophilic colloid containing layers of photographic elements it is accepted practice to harden the hydrophilic colloid. This reduces the ingestion of water during processing, thereby decreasing layer swell and improving adherence of the layers to each other and the support. Conventional hardeners for the hydrophilic colloid containing layers of photographic elements are illustrated by *Research Disclosure,* Vol. 176, January 1978, Item 17643, Section X, and *Research Disclosure,* Vol. 308, December 1989, pp.993–1,015, the disclosures of which are here incorporated by reference. Research Disclosure is published by Kenneth Mason Publications, Ltd., Emsworth, Hampshire P010 7DD, England. The 1989 publication will be identified hereafter as "*Research Disclosure*".

Acrylate polymer latices incorporated in the layers of the photographic materials of this invention need not be hardenable. However, it is a common practice to include in latices employed in the hydrophilic colloid layers of photographic elements at least a minor amount of repeating units capable of providing hardening sites.

In one preferred form the acrylate polymers employed in the practice of this invention contain from about 5 to 20 percent by weight of repeating units derived from vinyl monomers units capable of providing hardening sites. Illustrative of vinyl monomers of this class are as follows:

$$V—(L)_m—H$$

where

V is a group having a vinyl unsaturation site;

L is a divalent linking group;

m is the integer one or zero; and

H is a moiety providing a hardening site, such as an active methylene moiety, an aziridine or oxirane moiety, a primary amino moiety, or a vinyl precursor moiety.

Hardenable sites can take a variety of forms. In a very common form the repeating unit can contain a readily displaceable hydrogen, such as an active methylene site, created when a methylene group is positioned between two strongly electron withdrawing groups, typically between two carbonyl groups or between a carbonyl group and a cyano group. Since the primary amino groups of gelatin, widely employed as a photographic hydrophilic colloid, provide hardening sites, it is also contemplated to incorporate repeating units that contain a primary amino group in the acrylate polymer to facilitate hardening. Another approach to providing a hardening site is to incorporate a vinyl precursor moiety, such as a repeating unit that is capable of dehydrohalogenation in situ to provide a vinyl group. Monomers which at the time of polymerization contain two or more vinyl groups, such as divinylbenzene, are preferably avoided or minimized to reduce crosslinking of the acrylate polymer. Stated another way, acrylate polymers are preferred which prior to hardening are linear polymers. Moieties containing strained rings, such as aziridine and oxirane (ethylene oxide) rings, are also capable of providing active hardening sites.

The monomers set out in Table IV are illustrative of those capable of providing repeating units providing hardening sites.

Table IV

Ha. 2-Cyano-N-2-propenylacetamide (30764-67-1)

Hb. 2-Methyl-2-propenoic acid, 2-aminoethyl ester, hydrochloride (2420-94-2)

Hc. 2-Propenoic acid, 2-aminoethyl ester (7659-38-3)

Hd. N-Methacryloyl-N'-glycylhydrazine hydrochloride

He. 5-Hexene-2,4-dione (52204-69-0)

Hf. 5-Methyl-5-Hexene-2,4-dione (20583-46-4)

Hg. 2-Methyl-2-propenoic acid, 2-[(cyanoacetyl)-oxy]ethyl ester (21115-26-4)

Hh. 2-Propenoic acid, oxidranylmethyl ester (106-90-1)

Hi. 2-Methyl-2-propenoic acid, oxidranylmethyl ester (106-90-2)

Hj. Acetoacetoxy-2,2-dimethylpropyl methacrylate

Hk. 3-Oxo-4-pentenoic acid, ethyl ester (224105-80-0)

Hl. N-(2-Aminoethyl)-2-methyl-2-propenamide, monohydrochloride (76259-32-0)

Hm. 3-oxo-butanoic acid, 2-[(2-methyl-1-oxo-2-propenyl)oxy]ethyl ester (21282-87-3)

Hn. 2-Propenamido-4-(2-chloroethylsulfonyl-methyl)-benzene

Ho. 3-(2-ethylsulfonylmethyl)styrene

Hp. 4-(2-ethylsulfonylmethyl)styrene

Hq. N-(2-Amino-2-methylpropyl)-N'-ethenyl-butanediamide (41463-58-5)

Hr. Propenamide (79-06-1)

Still other repeating units can be incorporated in the polymers of this invention. The other repeating units can be employed to adjust the glass transition temperature, the hydrophobicity or hydrophilicity for a specific application. Styrenic repeating units (including repeating units derived from styrene and styrene substituted by hydrogen displacement, such as halo and alkyl substituted styrene monomers) and acrylamides (including halo and alkyl substituted acrylamides (e.g., methacrylamides and N-hydroxyalkylacrylamides) are particularly contemplated. The styrenic repeating units necessarily contain at least eight and preferably contain up to about 16 carbon atoms. The acrylamides and substituted acrylamides require only two carbon atoms and preferably contain up to about 10 carbon atoms, optimally up to about six carbon atoms.

The monomers set out in Table V are illustrative of simple repeating units that can be employed to modify the hydrophobicity of the polymers.

Table V

Oa. Styrene

Ob. (1-Methylethenyl)benzene (98-83-9)

Oc. 3-Chloromethylstyrene
Od. 4-Chloromethylstyrene
Oe. 3-Octadecyloxystyrene
Of. 4-Octadecyloxystyrene
Og. N-(3-Hydroxyphenyl)-2-methyl-2-propenamide (14473-49-5)
Oh. 2-Propenoic acid, 2-hydroxethyl ester (818-61-1)
Oi. 2-Propenoic acid, 2-hydroxypropyl ester
Oj. N-(1-Methylethyl)-2-propenamide (2210-25-5)
Ok. 3-Ethenylbenzoic acid
Ol. 4-Ethenylbenzoic acid
Om. N-(2-Hydroxypropyl)-2-methyl-2-propenamide (21442-01-3)
On. N,2-Dimethyl-2-propenamide (3887-02-3)
Op. 2-Methyl-2-propenamide (79-39-0)
Oq. N-(2-Hydroxypropyl)-2-methyl-2-propenamide (21442-01-3)
Or. N-[2-hydroxy-1,1-bis(hydroxymethyl)ethyl]-2-propenamide (13880-05-2)
Os. N-(1,1-Dimethylethyl)-2-propenamide (107-58-4)
Ot. Acetic acid ethenyl ester (108-05-4)
Ou. 3-Methylstyrene
Ov. 4-Methylstyrene
Ow. N,N-dimethyl-2-propenamide (2680-03-7)

In addition to being selected to increase color saturation, the polymers employed in the layers can also be used as carriers for hydrophobic emulsion addenda as disclosed in U.S. Pat. No. 4,247,627. A wide variety of hydrophobic photographic addenda that can be associated with the polymers are disclosed in *Research Disclosure,* Item 19551, cited above, the disclosure of which is here incorporated by reference.

The polymers employed can be prepared by synthetic procedures well known in the art. Generally for the acrylate polymers, the acrylate ester monomers forming the repeating units of the polymer can be conveniently provided by reacting acrylic acid with an alcohol, phenol, or hydroxy substituted ether.

The photographic element of this invention must contain at least a first and a second silver halide emulsion layer, each layer sensitized to a different region of the spectrum. The photographic element may contain more than two silver halide emulsion layers and typically color photographic materials contain at least three silver halide emulsion layers sensitized to different regions, of the spectrum. As many of the silver halide emulsion layers as desired may contain or be in reactive association with DIR compounds provided at least one silver halide emulsion layer between the support and the barrier layer meets this requirement.

The barrier layer must be positioned further from the support of the photographic element than at least two of the silver halide emulsion layers. There may be more than two silver halide emulsion layers between the barrier layer and the support. Other layers such as filter layers, interlayers and subbing layers may be contained in the photographic element and the barrier layer may be positioned in relationship to these other layers in any manner. The barrier layer may be an interlayer or an overcoat layer. The polymer of this invention should not be incorporated into a silver halide emulsion layer because such incorporation regardless of the placement of the silver halide emulsion layer interferes with the color saturation effect.

It will be obvious that the photographic materials of this invention can enable the achievement of several results simultaneously and that the exact balance of results so enabled will depend on the particular choices of DIR compound and polymer latex order employed in a particular photographic material. For example, the specific degrees of interlayer and intralayer interimage effect can be manipulated by choice of the identity, position and quantity of DIR compound while the degree of color saturation can be manipulated by choice of the identity, position and quantity of anionic polymer latex.

In a similar vein, the balance of pressure fog protection, dry surface scratch resistance and wet surface scratch resistance can be similarly manipulated against color saturation by choice of the identity, position and quantity of the anionic polymer latex.

It will further be appreciated that the anionic polymer latexes described here can be used in combination with other anionically charged transportable photographically useful groups to control the details of their distribution within a film structure. Other typical photographically useful groups which can be released imagewise are described in U.S. Pat. Nos. 4,248,962 and 4,861,701, These groups can also be released in a nonimagewise manner or can be directly incorporated into a photographic material at coating or during processing treatments. These groups include but are not limited to development accelerators, bleach inhibitors, bleach accelerators, fix accelerators, soluble dyes, release dyes and so forth.

In addition, it will be appreciated that photographic materials comprising a combination of a cationically charged transportable photographically useful group will also enable control of the details of the distribution of such cationic groups within a film structure. Likewise, charged latex polymers will also be useful to exclude charged species present in a processing solution from the film structure.

It is believed that any DIR compound which releases an anionic development inhibitor may be used in this invention. Typical examples of DIR compounds, their preparation and methods of incorporation and utilization in photographic materials are disclosed in U.S. Pat. Nos. 3,227,554; 3,384,657; 3,379,529; 3,615,506; 3,617,291; 3,620,746; 3,701,783; 3,733,201; 4,049,455; 4,095,984; 4,248,962; 4,409,323; 4,855,220; 4,756,600; 4,962,018; 5,006,448 and 5,021,555 as well in "Development-Inhibitor-Releasing (DIR) Coupler in Color Photography", C. R. Barr, J. R. Thirtle and P. W. Vittum in *Photographic Science and Engineering,* vol 13, page 174 (1969). Other examples of useful DIR compounds are disclosed at Section VII of *Research Disclosure* as well as by commercially available materials.

These DIR compounds may be among those classified as "diffusible," meaning that they enable release of a highly transportable inhibitor moiety or they may be classified as "non-diffusible" meaning that they enable release of a less transportable inhibitor moiety. The DIR compounds may directly release an anionic development inhibitor moiety as a result of photographic processing or they may release an intervening timing or linking group which then releases an anionic development inhibitor moiety as known in the art. The DIR compounds may comprise two or more sequential timing groups as described in U.S. Pat. No. 4,861,701. The DIR compounds may also comprise both timing and linking groups.

The anionic inhibitor moiety of the DIR compound may be unchanged as the result of exposure to photographic processing solution. However, the inhibitor moiety may change in structure and effect in the manner disclosed in U.K. Patent No. 2,099,167; European Patent Application No. 167,168; Japanese Kokai 205150/83 or U.S. Pat. No. 4,782,012 as the result of photographic processing.

When the DIR compounds are dye-forming couplers, they may be incorporated in reactive association with complementary color sensitized silver halide emulsions, as for example a cyan dye-forming DIR coupler with a red sensitized emulsion or in a mixed mode, as for example a yellow dye-forming DIR coupler with a green sensitized emulsion, all as known in the art.

The DIR compounds may also be incorporated in reactive association with bleach accelerator releasing couplers as disclosed in U.S. Pat. No. 4,912,024; European Patent No. 193,389B and in U.S. patent application Ser. Nos. 563,725 filed Aug. 8, 1990 and 612,341 file Nov. 13, 1990.

Some examples of suitable DIR's are shown below:

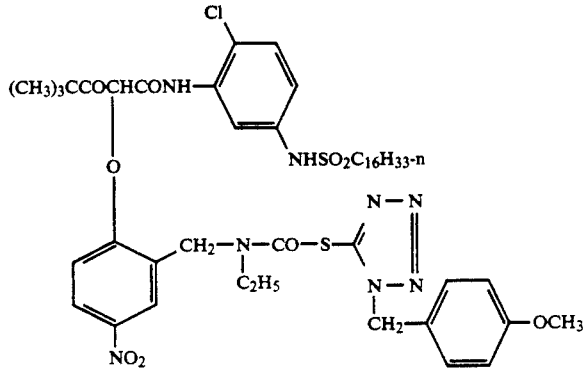

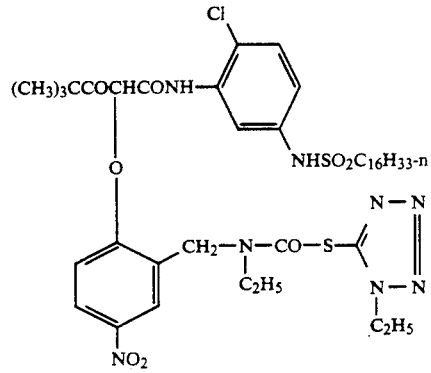

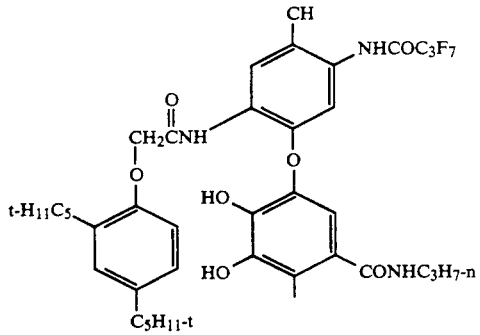

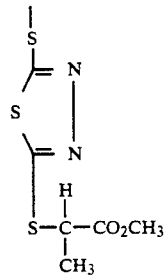

-continued
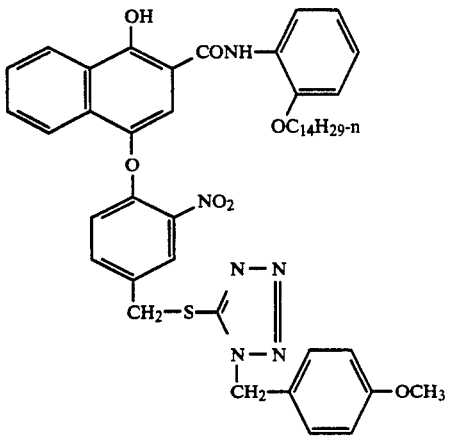
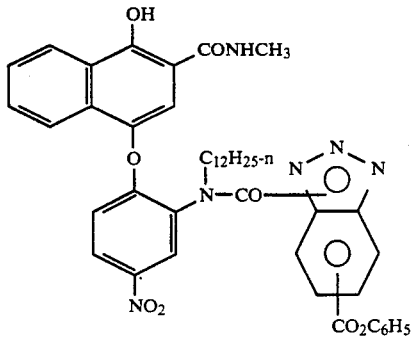
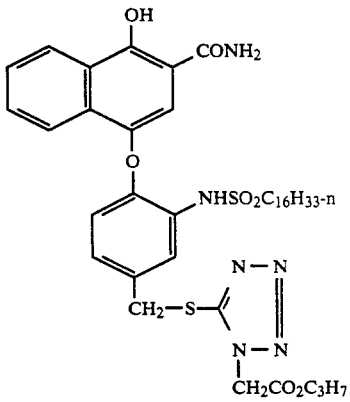
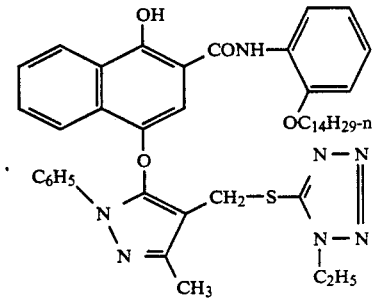

-continued

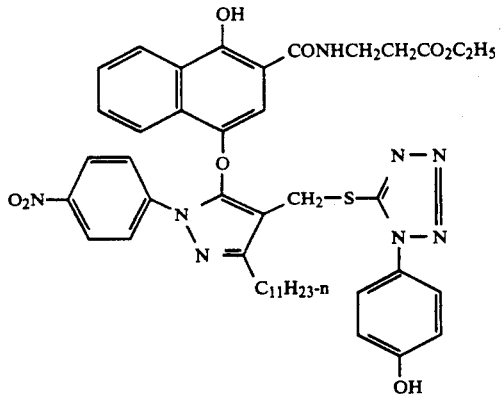

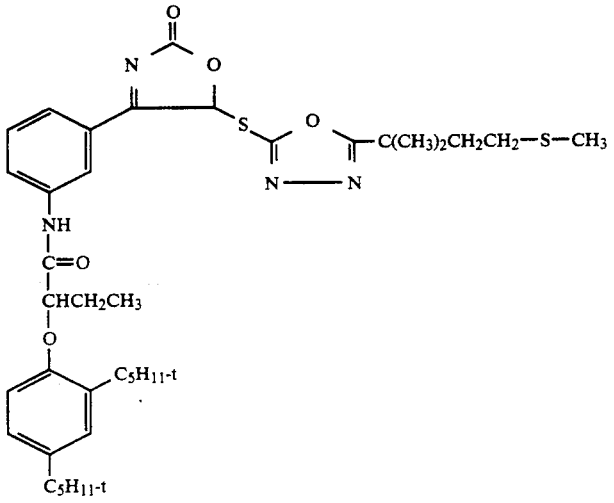

These DIR compounds may be incorporated in the same layer as the emulsions in this invention, or in reactive association with these layers, all as known in the art.

While any conventional hydrophilic colloid peptizer or combination of peptizers can be employed in combination with one or more polymers selected, preferred hydrophilic colloids for use in the practice of this invention are gelatino-peptizers, e.g., gelatin, oxidized gelatin and modified gelatin (also referred to as gelatin derivatives). Useful hydrophilic colloid peptizers including gelatino-peptizers are disclosed in *Research Disclosure,* (cited above), Item 17643, Section IX, Paragraph A, here incorporated by reference. Of the various modified forms of gelatin, acetylated gelatin and phthalated gelatin constitute preferred gelatin derivatives. Specific useful forms of gelatin and gelatin derivatives can be chosen from among those disclosed by Yutzy et al. U.S. Pat. Nos. 2,614,928 and 2,614,929; Lowe et al. U.S. Pat. Nos. 2,614,930 and 2,614,931; Gates U.S. Pat. Nos. 2,787,545 and 2,956,880; Ryan U.S. Pat. No. 3,186,846; Dersch et al. U.S. Pat. No. 3,436,220; Luciani et al. U.K. Patent 1,186,790; and Maskasky U.S. Pat. No. 4,713,320.

The silver halide emulsions employed in the materials of this invention can be comprised of silver bromide, silver chloride, silver iodide, silver chlorobromide, silver chloroiodide, silver bromoiodide, silver chlorobromoiodide or mixtures thereof. The emulsions can include silver halide grains of any conventional shape or size. Examples of suitable silver halide emulsions are discussed in *Research Disclosure* No. 308119, Section I. Specifically, the emulsions can include coarse, medium or fine silver halide grains. High aspect ratio tabular grain emulsions may be advantageous, such as those disclosed by Wilgus, et al. U.S. Pat. No. 4,434,226, Daubendiek, et al. U.S. Pat. No. 4,414,310, Kofron, et al. U.S. Pat. No. 4,439,520, Wey U.S. Pat. No. 4,399,215, Solberg, et al. U.S. Pat. No. 4,433,048 Mignot U.S. Pat. No. 4,386,156, Evans, et al. U.S. Pat. No. 4,504,570. Maskasky U.S. Pat. No. 4,400,463, Wey, et al. U.S. Pat. No. 4,414,306, Maskasky U.S. Pat. Nos. 4,435,501 and 4,643,996 and Daubendiek, et al. U.S. Pat. Nos. 4,672,027 and 4,693,964. Also advantageous are those silver bromoiodide grains with a higher molar proportion of iodide in the core of the grain than in the periphery of the grain, such as those described in GB 1,027,146; JA 54/48,521; U.S. Pat. No. 4,379,837; U.S. Pat. No. 4,444,877; U.S. Pat. No. 4,665,012; U.S. Pat. No. 4,686,178; U.S. Pat. No. 4,565,778; U.S. Pat. No. 4,728,602; U.S. Pat. No. 4,668,614; U.S. Pat. No. 4,636,461; EP 264,954.

The silver halide emulsions can be either monodisperse or polydisperse as precipitated. The grain size distribution of the emulsions can be controlled by silver halide grain separation techniques or by blending silver halide emulsions of differing grain sizes.

The high aspect ratio tabular grain silver halide emulsion and other emulsions useful in the practice of this invention can be characterized by geometric relationships, specifically the Aspect Ratio and the Tabularity. The Aspect Ratio (AR) and the Tabularity (T) are defined by the following equations:

$$AR = \frac{\text{Equivalent Circular Diameter}}{\text{Thickness}}$$

$$T = \frac{\text{Equivalent Circular Diameter}}{\text{Thickness} \times \text{Thickness}}$$

where the equivalent circular diameter and the thickness of the grains, measured using methods commonly known in the art, are expressed in units of microns.

High Aspect Ratio Tabular Grain Emulsions useful in this invention have an Aspect Ratio greater than 3, are preferred to have an AR greater than 5 and are most preferred to have an AR greater than 10. These useful emulsions additionally can be characterized in that their Tabularity is greater than 10 and they ate preferred to have T greater than 50.

Sensitizing compounds, such as compounds of copper, thallium, lead, bismuth, cadmium and Group VIII noble metals, can be present during precipitation of the silver halide emulsion.

The emulsions can be surface-sensitized emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or. unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure,* Item308119. cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and poly-nuclear cyanines and merocyanines), oxonols, hemioxonols, styryls, merostyryls, and strptocyanines. Illustrative spectral sensitizing dyes are disclosed in *Research Disclosure,* Item 308119, cited above, Section IV.

The materials of this invention can include, among others, couplers as described in *Research Disclosure* Section VII, paragraphs D, E, F and G and the publications cited therein. These additional couplers can be incorporated as described in *Research Disclosure* Section VII, paragraph C and the publications cited therein.

The photographic material of this invention can contain, for example, brighteners (*Research Disclosure* Section V), antifoggants and stabilizers *Research Disclosure* Section VI), antistain agents and image dye stabilizers (*Research Disclosure* Section VII, paragraphs I and J), light absorbing and scattering materials (*Research Disclosure* Section VIII), hardners (*Research Disclosure* Section XI), plasticizers and lubricants (*Research Disclosure* Section XII), antistatic agents (*Research Disclosure* Section XIII), matting agents (*Research Disclosure* Section XVI) and development modifiers (*Research Disclosure* Section XXI).

The photographic material can be coated on a variety of supports including those described in Research Disclosure Section XVII and the references described therein.

The photographic material can be exposed to actintic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the material with a color developing agent to reduce developable silver halide and oxidize the color developing agent. Oxidized color developing agent in turn reacts with the coupler to yield a dye.

With negative working silver halide this processing step leads to a negative image. To obtain a positive (or reversal) image, this step can be preceded by development with a non-chromogenic developing agent to develop exposed silver halide, but not form dye, and then uniform fogging of the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

Typical bleach baths contain an oxidizing agent to convert elemental silver, formed during the development step, to silver halide. Suitable bleaching agents include ferricyanides, dichromates, ferric complexes of aminocarboxylic acids, including ethylenediamines tetra-acetate and propylene diamine tetra-acetate, persulfates, peroxides and other peracids.

Fixing baths contain a complexing agent that will solubilize the silver halide in the material and permit its removal from the material. Typical fixing agents include thiosulfates, bisulfites and such, especially as their sodium and/or ammonium salt and ethylene diamine tetra-active acid salts. The bleaching and fixing baths can be combined in a bleach/fix bath.

Structures for various compounds used in the following examples are given below.

B-1

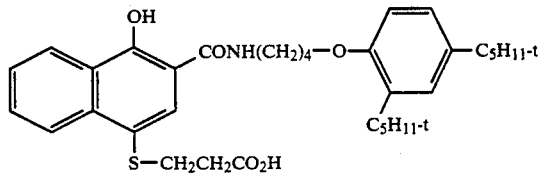

-continued
B-2
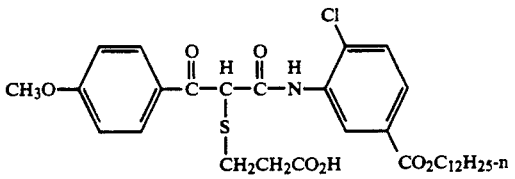
C-1
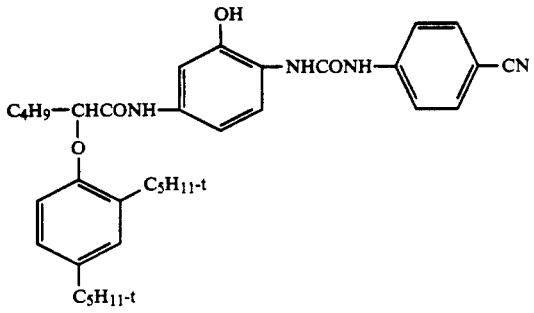
C-2
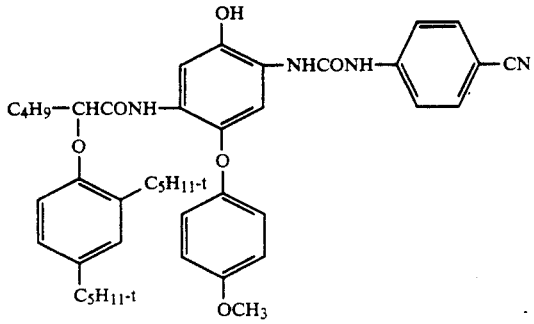
CD-2
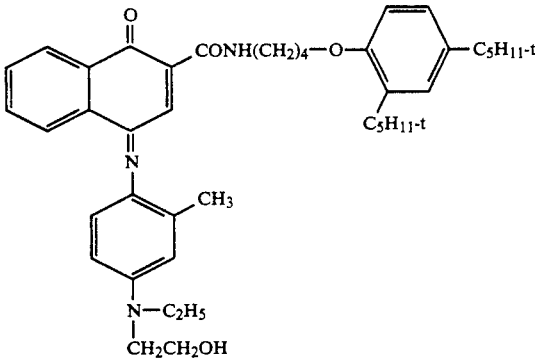
CM-1
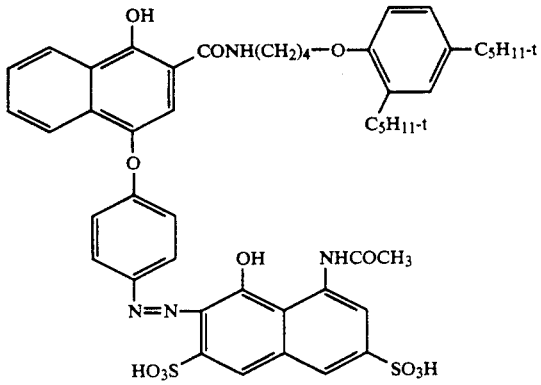

-continued
D-1
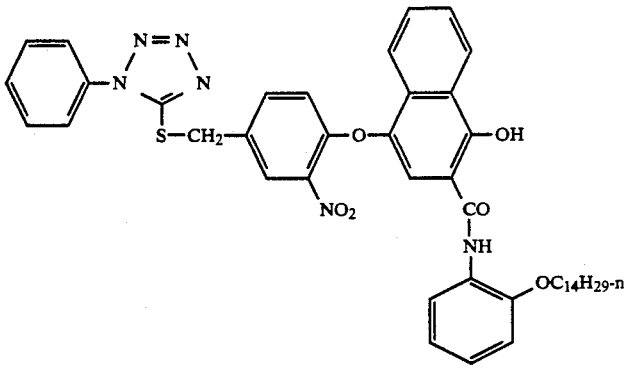
D-2
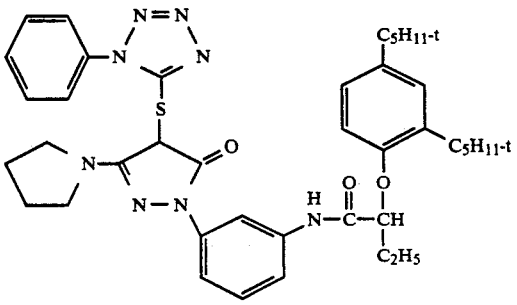
D-3
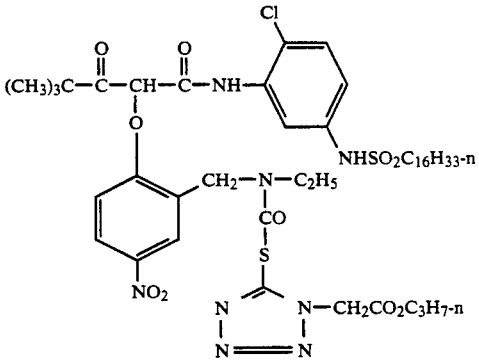
D-4
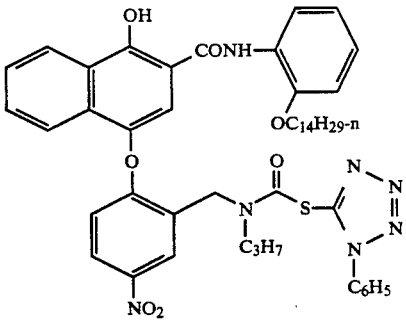
D-7
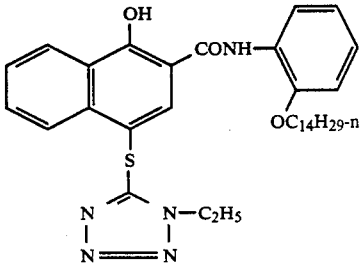

-continued
D-9
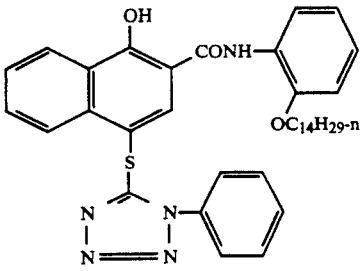
D-10
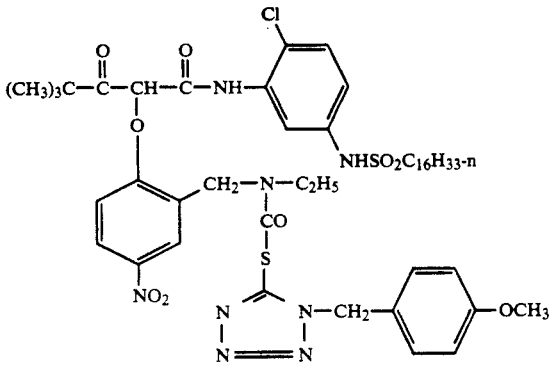
M-1
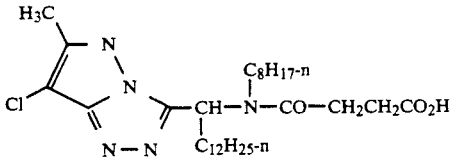
M-2
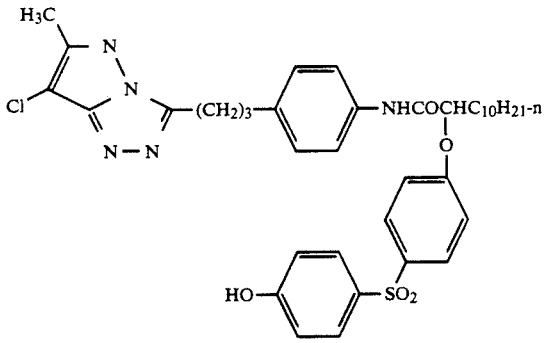
MD-1
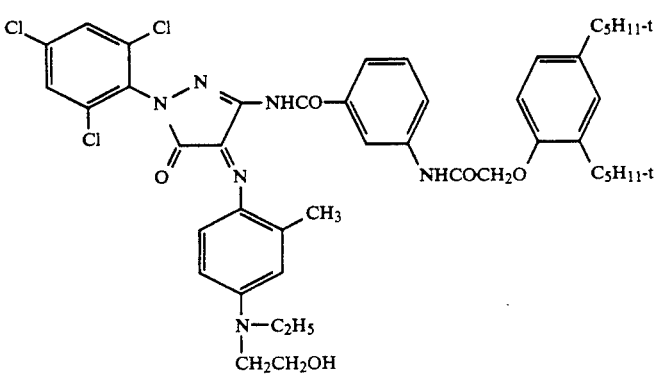

-continued
MM-1
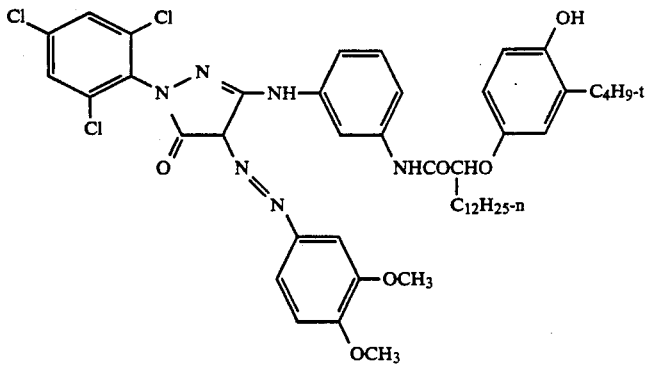
MM-2
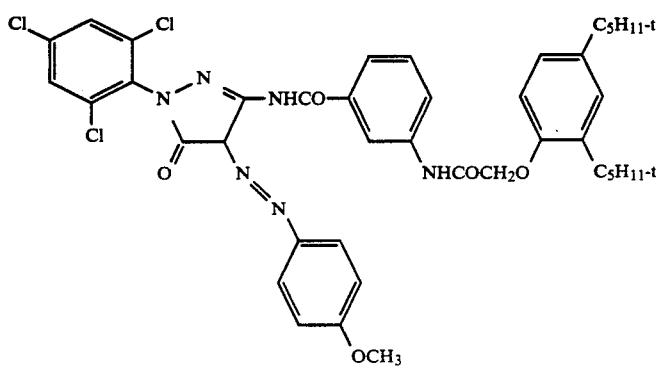
S-1
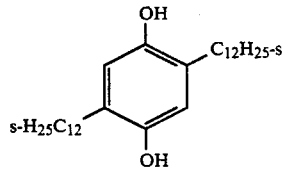
UV-1
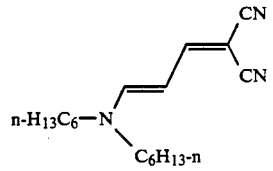
UV-2
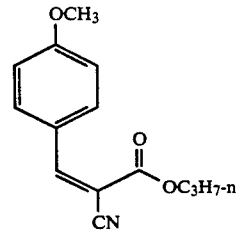
Y-1
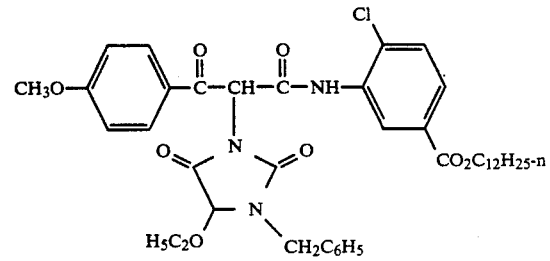

-continued

YD-1

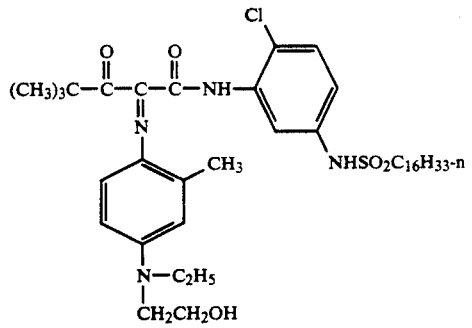

YD-2

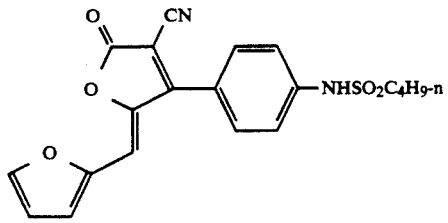

EXAMPLES

The following examples are provided to illustrate certain embodiments of the invention and are not intended to limit the invention.

PREPARATIVE EXAMPLE 1:—Samples 101 to 210

A color photographic recording material (Photographic Sample 101) for color negative development was prepared by applying the following layers in the given sequence to a transparent support of cellulose acetate. The quantities of silver halide are given in grams of silver per $m^2$. The quantities of other materials are given in $g/m^2$. All silver halide emulsions were stabilized with 2 grams of 4-hydroxy-6-methyl-1,3,3a,7-tetraazaindene per mole of silver. Compounds M-1, M-2 and D-2 were used as emulsions containing tricresylphosphate. Compounds C-1, C-2, Y-1 and D-3 were used as emulsions containing di-n-butyl phthalate. Compound D-1 was used as an emulsion containing N-n-butyl acetanalide. Compounds UV-1 and UV-2 were used as emulsions containing 1,4-cyclohexylenedimethylene bis-(2-ethoxyhexanoate).

Layer 1 {Antihalation Layer} black colloidal silver sol containing 0.323 g of silver, dye UV-1 at 0.075 g, dye MD-1 at 0.016 g, dye CD-2 at 0.027 g, MM-2 at 0.13 g with 2.44 g gelatin.

Layer 2 {First Red-Sensitive Layer} Red sensitized silver iodobromide emulsion (3.7 mol % iodide, average grain diameter 0.7 microns, average grain thickness 0.09 micron) at 0.27 g, red sensitized silver iodobromide emulsion (5 mol % iodide, average grain diameter 1.2 microns, average grain thickness 0.1 micron) at 0.16 g, cyan dye-forming image coupler C-1 at 0.48 g, DIR compound D-1 at 0.003 g, DIR compound D-7 at 0.011, BAR (Bleach Accelerator Releasing) compound B-1 at 0.032 g, with gelatin at 1.61 g.

Layer 3 {Second Red-Sensitive Layer} Red sensitized silver iodobromide emulsion (4.2 mol % iodide, average grain diameter 2.1 microns, average grain thickness 0.09 microns) at 0.48 g, cyan dye-forming image coupler C-2 at 0.17 g, DIR compound D-7 at 0.011 g, DIR compound D-9 at 0.007 g BAR compound B-1 at 0.011 g, cyan dye-forming masking coupler CM-1 at 0.043 g with gelatin at 1.29 g.

Layer 4 {Interlayer} Oxidized developer scavenger S-1 at 0.054 g and 1.61 g of gelatin.

Layer 5 {First Green-Sensitive Layer} Green sensitized silver iodobromide emulsion (2.6 mol % iodide, average grain diameter 0.65 microns, average thickness 0.09 microns) at 0.22 g, green sensitized silver iodobromide emulsion (4 mol % iodide, average grain diameter 1.5 microns, average thickness 0.08 microns) at 0.21 g, magenta dye-forming image coupler M-1 at 0.11 g, magenta dye-forming image coupler M-2 at 0.25 g, DIR compound D-9 at 0.005 g, with gelatin at 1.29 g.

Layer 6 {Second Green-Sensitive Layer} Green sensitized silver iodobromide emulsion (4.2 mol % iodide, average grain diameter 2.1 microns, average grain thickness 0.09 microns) at 0.43 g, magenta dye-forming image coupler M-1 at 0.065 g, magenta dye-forming masking coupler MM-1 at 0.032 g, DIR compound D-9 at 0.005 g, with gelatin at 1.08 g.

Layer 7 {Interlayer} Oxidized developer scavenger S-1 at 0.054 g, dye YD-2 at 0.18 g with 1.61 g of gelatin.

Layer 8 {First Blue-Sensitive Layer} Blue sensitized silver iodobromide emulsion (3.6 mol % iodide, average grain diameter 0.8 microns, average grain thickness 0.09 micron) at 0.33 g, blue sensitized silver iodobromide emulsion (3.6 mol % iodide, average grain diameter 1.5 microns, average grain thickness 0.09 micron) at 0.16 g, yellow dye-forming image coupler Y-1 at 0.86 g, DIR compound D-3 at 0.034 g, with gelatin at 1.61 g.

Layer 9 {Second Blue-Sensitive Layer} Blue sensitized silver iodobromide emulsion (2.9 mol % iodide, average grain diameter 2.5 microns, average grain thickness 0.12 microns) at 0.75 g, yellow dye-forming image coupler Y-1 at 0.22 g, DIR compound D-3 at 0.032 g, with gelatin at 1.29 g.

Layer 10 {Protective Layer 1} 0.108 g of dye UV-1, 0.118 g of dye UV-2 with gelatin at 0.54 g.

Layer 11 {Protective Layer 2} Unsensitized silver bromide Lippman emulsion at 0.108 g, anti-matte polymethylmethacrylate beads at 0.0538 g with gelatin at 0.54 g.

This film was hardened at coating with 2% by weight to total gelatin of a conventional hardner H-1 (bis(vinylsulfonyl)methane). Surfactants, coating aids, scavengers, soluble absorber dyes and stabilizers were added to the various layers of this sample as is commonly practiced in the art.

Photographic Sample 102 was like Photographic Sample 101 except that 0.59 g of Polymer Latex A was added to layer 10.

Photographic Sample 103 was like Photographic Sample 101 except that 1.07 g of Polymer Latex A was added to layer 10.

Photographic Sample 104 was like Photographic Sample 101 except that 1.99 g of Polymer Latex A was added to layer 10.

Photographic Sample 105 was like Photographic Sample 101 except that 0.59 g of tricresyl phosphate was added as an emulsion to layer 10.

Photographic Sample 106 was like Photographic Sample 101 except that 1.07 g of tricresyl phosphate was added as an emulsion to layer 10.

Photographic Sample 107 was like Photographic Sample 101 except that 0.59 g of Polymer Latex D was added to layer 10.

Photographic Sample 108 was like Photographic Sample 101 except that 1.07 g of Polymer Latex D was added to layer 10.

Photographic Sample 109 was like Photographic Sample 101 except that 1.99 g of Polymer Latex D was added to layer 10.

Photographic Sample 110 was like Photographic Sample 101 except that 1.99 g of Polymer Latex C was added to layer 10.

Photographic Sample 201 was prepared like Photographic Sample 101 except that 1.29 g of gelatin was used in layer 10.

Photographic Sample 202 was like Photographic Sample 201 except that 0.59 g of Polymer Latex A was added to layer 10.

Photographic Sample 203 was like Photographic Sample 201 except that 1.07 g of Polymer Latex A was added to layer 10.

Photographic Sample 204 was like Photographic Sample 201 except that 1.99 g of Polymer Latex A was added to layer 10.

Photographic Sample 205 was like Photographic Sample 201 except that 1.07 g of tricresyl phosphate was added as an emulsion to layer 10.

Photographic Sample 206 was like Photographic Sample 201 except that 1.99 g of tricresyl phosphate was added as an emulsion to layer 10.

Photographic Sample 207 was like Photographic Sample 201 except that 0.59 g of Polymer Latex D was added to layer 10.

Photographic Sample 208 was like Photographic Sample 201 except that 1.07 g of Polymer Latex D was added to layer 10.

Photographic Sample 209 was like Photographic Sample 201 except that 1.99 g of Polymer Latex D was added to layer 10.

Photographic Sample 210 was like Photographic Sample 201 except that 1.99 g of Polymer Latex C was added to layer 10.

PREPARATIVE EXAMPLE 2:—Samples 301 to 312

Photographic Sample 301 was prepared in a manner similar to that used for Photographic Sample 101 by applying the following layers in the given sequence to a transparent support of cellulose triacetate.

Layer 1 {Antihalation Layer} black colloidal silver sol containing 0.236 g silver with 2.44 g gelatin.

Layer 2 {First Red-Sensitive Layer} Red sensitized silver iodobromide emulsion (3.9 mol % iodide, average grain diameter 0.6 microns, average grain thickness 0.09 micron) at 0.28 g, red sensitized silver iodobromide emulsion (5 mol % iodide, average grain diameter 1.2 microns, average grain thickness 0.1 micron) at 0.19 g, cyan dye-forming image coupler C-2 at 0.43 g, DIR compound D-1 at 0.027 g, BAR compound B-1 at 0.016 g, with gelatin at 1.61 g.

Layer 3 {Second Red-Sensitive Layer} Red sensitized silver iodobromide emulsion (4.2 mol % iodide, average grain diameter 2.1 microns, average grain thickness 0.09 microns) at 0.5 g, cyan dye-forming image coupler C-2 at 0.18 g, DIR compound D-1 at 0.018 g, BAR compound B-1 at 0.016 g, with gelatin at 1.29 g.

Layer 4 (Interlayer} Oxidized developer scavenger S-1 at 0.054 g and 0.65 g of gelatin.

Layer 5 [First Green-Sensitive Layer} Green sensitized silver iodobromide emulsion (2.6 mol % iodide, average grain diameter 0.65 microns, average thickness 0.09 microns) at 0.19 g, green sensitized silver iodobromide emulsion (4 mol % iodide, average grain diameter 1.2 microns, average thickness 0.09 microns) at 0.09 g, magenta dye-forming image coupler M-1 at 0.15 g, magenta dye-forming image coupler M-2 at 0.19 g, DIR compound D-1 at 0.011 g, with gelatin at 1.27 g.

Layer 6 {Second Green-Sensitive Layer} Green sensitized silver iodobromide emulsion (4.2 mol % iodide, average grain diameter 2.1 microns, average grain thickness 0.07 microns) at 0.43 g, magenta dye-forming image coupler M-1 at 0.048 g, magenta dye-forming image coupler M-2 at 0.038 g, DIR compound D-2 at 0.01 g, with gelatin at 0.97 g.

Layer 7 {Interlayer} Oxidized developer scavenger S-1 at 0.054 g, yellow colloidal silver at 0.021 g with 0.65 g of gelatin.

Layer 8 {First Blue-Sensitive Layer} Blue sensitized silver iodobromide emulsion (3.6 mol % iodide, average grain diameter 0.8 microns, average grain thickness 0.09 micron) at 0.54 g, blue sensitized silver iodobromide emulsion (3.6 mol % iodide, average grain diameter 1.5 microns, average grain thickness 0.09 micron) at 0.32 g, yellow dye-forming image coupler Y-1 at 0.86 g, DIR compound D-3 at 0.026 g, BAR compound B-2 at 0.026 g, with gelatin at 1.4 g.

Layer 9 {Second Blue-Sensitive Layer} Blue sensitized silver iodobromide emulsion (2.9 mol % iodide, average grain diameter 2.5 microns, average grain thickness 0.12 microns) at 0.54 g, yellow dye-forming image coupler Y-1 at 0.22 g, DIR compound D-3 at 0.006 g, BAR compound B-2 at 0.006 g, with gelatin at 0.75 g.

Layer 10 {Protective Layer 1} 0.108 g of dye UV-1, 0.118 g of dye UV-2, with gelatin at 0.54 g.

Layer 11 {Protective Layer 2} Unsensitized silver bromide Lippmann emulsion at 0.108 g, anti-matte polymethylmethacrylate beads at 0.0538 g with gelatin at 0.54 g.

This film was hardened at coating with 2% by weight to total gelatin of hardner H-1. Surfactants, coating aids, scavengers, soluble absorber dyes and stabilizers were added to the various layers of this sample as is commonly practiced in the art.

Photographic Sample 302 was like Photographic Sample 301 except that 2.15 g of Polymer Latex A was added to layer 10.

Photographic Sample 303 was like Photographic Sample 301 except that 1.07 g of Polymer Latex A was added to layer 10.

Photographic Sample 304 was like Photographic Sample 301 except that 2.15 g of Polymer Latex C was added to layer 10.

Photographic Sample 305 was like Photographic Sample 301 except that 1.07 g of Polymer Latex C was added to layer 10.

Photographic Sample 306 was like Photographic Sample 301 except that 1.58 g of Polymer Latex D was added to layer 10.

Photographic Sample 307 was like Photographic Sample 301 except that 0.79 g of Polymer Latex D was added to layer 10.

Photographic Sample 308 was like Photographic Sample 301 except that 2.15 g of Polymer Latex B was added to layer 10.

Photographic Sample 309 was like Photographic Sample 301 except that 1.07 g of Polymer Latex B was added to layer 10.

Photographic Sample 310 was like Photographic Sample 302 except that the Lippmann emulsion was omitted from layer 11 and incorporated in layer 10.

Photographic Sample 311 was like Photographic Sample 301 except that 1.07 g of Polymer Latex F was added to layer 10.

Photographic Sample 312 was like Photographic Sample 301 except that 0.59 g of Polymer Latex F was added to layer 10.

PREPARATIVE EXAMPLE 3:—Samples 401 to 406

Photographic Sample 401 was prepared in a manner similar to that used for Photographic Sample 101 by applying the following layers in the given sequence to a transparent support of cellulose acetate.

Layer 1 {Antihalation Layer} black colloidal silver sol containing 0.236 g of silver and 2.44 g gelatin.

Layer 2 {First Red-Sensitive Layer} Red sensitized silver iodobromide emulsion (2.5 mol % iodide, average grain diameter 0.8 microns, average grain thickness 0.09 micron) at 0.36 g, red sensitized silver iodobromide emulsion (5 mol % iodide, average grain diameter 1.3 microns, average grain thickness 0.1 micron) at 0.35 g, cyan dye-forming image coupler C-1 at 0.538 g, DIR compound D-1 at 0.052 g, BAR compound B-1 at 0.016 g, cyan dye-forming masking coupler CM-1 at 0.068 g, with gelatin at 1.61 g.

Layer 3 {Second Red-Sensitive Layer} Red sensitized silver iodobromide emulsion (3.9 mol % iodide, average grain diameter 2.1 microns, average grain thickness 0.075 microns) at 0.74 g, cyan dye-forming image coupler C-2 at 0.29 g, DIR compound D-1 at 0.011 g, cyan dye-forming masking coupler CM-1 at 0.029 g, with gelatin at 1.15 g.

Layer 4 {Interlayer} Oxidized developer scavenger S-1 at 0.054 g and 0.645 g of gelatin.

Layer 5 {First Green-Sensitive Layer} Green sensitized silver iodobromide emulsion (2.5 mol % iodide, average grain diameter 0.77 microns, average thickness 0.09 microns) at 0.35 g, green sensitized silver iodobromide emulsion (3 mol % iodide, average grain diameter 1.05 microns, average thickness 0.12 microns) at 0.17 g, magenta dye-forming image coupler M-1 at 0.30 g, magenta dye-forming image coupler M-2 at 0.13 g, DIR compound D-1 at 0.028 g, with gelatin at 1.16 g.

Layer 6 {Second Green-Sensitive Layer} Green sensitized silver iodobromide emulsion (3 mol % iodide, average grain diameter 1.95 microns, average grain thickness 0.08 microns) at 0.65 g, magenta dye-forming image coupler M-1 at 0.075 g, magenta dye-forming image coupler M-2 at 0.032 g, DIR compound D-2 at 0.019 g, with gelatin at 0.97 g.

Layer 7 {Interlayer} Oxidized developer scavenger S-1 at 0.054 g, yellow colloidal silver at 0.0215 g with 0.645 g of gelatin.

Layer 8 {First Blue-Sensitive Layer} Blue sensitized silver iodobromide emulsion (3.7 mol % iodide, average grain diameter 1 microns, average grain thickness 0.09 micron) at 0.5 g, yellow dye-forming image coupler Y-1 at 1.08 g, DIR compound D-3 at 0.038 g, BAR compound B-2 at 0.022 g with gelatin at 1.61 g.

Layer 9 {Second Blue-Sensitive Layer} Blue sensitized silver iodobromide emulsion (2.9 mol % iodide, average grain diameter 2.9 microns, average grain thickness 0.12 microns) at 0.65 g, yellow dye-forming image coupler Y-1 at 0.43 g, DIR compound D-3 at 0.019 g, BAR compound B-2 at 0.022 g with gelatin at 1.21 g Layer 10 {Protective Layer 1} 0.108 g of dye UV-1, 0.118 g of dye UV-2, and gelatin at 0.97 g.

Layer 11 {Protective Layer 2} Unsensitized silver bromide Lippman emulsion at 0.108 g, anti-matte polymethylmethacrylate beads at 0.0538 g with gelatin at 0.54 g.

This film was hardened at coating with 2% by weight to total gelatin of hardner H-1. Surfactants, coating aids, scavengers, soluble absorber dyes and stabilizers were added to the various layers of this sample as is commonly practiced in the art.

Photographic Sample 402 was like Photographic Sample 401 except that 2.15 g of tricresyl phosphate was added as an emulsion to layer 10.

Photographic Sample 403 was like Photographic Sample 401 except that 2.15 g of Polymer Latex E was added to layer 10.

Photographic Sample 404 was like Photographic Sample 401 except that 1.07 g of Polymer Latex F was added to layer 10.

Photographic Sample 405 was like Photographic Sample 401 except that 1.43 g of Polymer Latex G was added to layer 10.

Photographic Sample 406 was like Photographic Sample 401 except that 2.15 g of Polymer Latex A was added to layer 10.

PREPARATIVE EXAMPLE 4:—Samples 601 to 616

Photographic Sample 601 was prepared in a manner analogous to Photographic Sample 101 by applying the following layers in the given sequence to a transparent support of cellulose acetate.

Layer 1 {Antihalation Layer} black colloidal silver sol containing 0.323 g of silver, dye UV-1 at 0.075 g, dye MD-1 at 0.016 g, dye CD-2 at 0.027 g, MM-2 at 0.13 g with 2.44 g gelatin.

Layer 2 {First Red-Sensitive Layer} Red sensitized silver iodobromide emulsion (3.7 mol % iodide, average grain diameter 0.7 microns, average grain thickness 0.09 micron) at 0.27 g, red sensitized silver iodobromide emulsion (5 mol % iodide, average grain diameter 1.2 microns, average grain thickness 0.1 micron) at 0.16 g, cyan dye-forming image coupler C-1 at 0.48 g, DIR compound D-1 at 0.003 g, DIR compound D-7 at 0.011 BAR compound B-1 at 0.032 g, with gelatin at 1.61 g.

Layer 3 {Second Red-Sensitive Layer} Red sensitized silver iodobromide emulsion (4.2 mol % iodide, average grain diameter 2.1 microns, average grain thickness 0.09 microns) at 0.48 g, cyan dye-forming image coupler C-2 at 0.17 g, DIR compound D-7 at 0.011 g, DIR compound D-9 at 0.007 g BAR compound B-1 at 0.011 g, cyan dye-forming masking coupler CM-1 at 0.043 g with gelatin at 1.29 g.

Layer 4 {Interlayer} Oxidized developer scavenger S-1 at 0.054 g and 1.61 g of gelatin.

Layer 5 {First Green-Sensitive Layer} Green sensitized silver iodobromide emulsion (2.6 mol % iodide, average grain diameter 0.65 microns, average thickness 0.09 microns) at 0.22 g, green sensitized silver iodobromide emulsion (4 mol % iodide, average grain diameter 1.5 microns, average thickness 0.08 microns) at 0.21 g, magenta dye-forming image coupler M-1 at 0.11 g, magenta dye-forming image coupler M-2 at 0.25 g, DIR compound D-9 at 0.005 g, with gelatin at 1.29 g.

Layer 6 {Second Green-Sensitive Layer} Green sensitized silver iodobromide emulsion (4.2 mol % iodide, average grain diameter 2.1 microns, average grain thickness 0.09 microns) at 0.43 g, magenta dye-forming image coupler M-1 at 0.065 g, magenta dye-forming masking coupler MM-1 at 0.032 g, DIR compound D-9 at 0.005 g, with gelatin at 1.08 g.

Layer 7 {Interlayer} Oxidized developer scavenger S-1 at 0.054 g, dye YD-2 at 0.18 g with 1.61 g of gelatin.

Layer 8 {First Blue-Sensitive Layer} Blue sensitized silver iodobromide emulsion (3.6 mol % iodide, average grain diameter 0.8 microns, average grain thickness 0.09 micron) at 0.33 g, blue sensitized silver iodobromide emulsion (3.6 mol % iodide, average grain diameter 1.5 microns, average grain thickness 0.09 micron) at 0.16 g, yellow dye-forming image coupler Y-1 at 0.86 g, DIR compound D-3 at 0.034 g, BAR compound B-2 at 0.022 g with gelatin at 1.61 g.

Layer 9 {Second Blue-Sensitive Layer} Blue sensitized silver iodobromide emulsion (2.9 mol % iodide, average grain diameter 2.5 microns, average grain thickness 0.12 microns) at 0.75 g, yellow dye-forming image coupler Y-1 at 0.22 g, DIR compound D-3 at 0.032 g, with gelatin at 1.29 g.

Layer 10 {Protective Layer 1} 0.108 g of dye UV-1, 0.118 g of dye UV-2 with gelatin at 0.54 g.

Layer 11 {Protective Layer 2} Unsensitized silver bromide Lippman emulsion at 0.108 g, anti-matte polymethylmethacrylate beads at 0.0538 g with gelatin at 0.54 g.

This film was hardened at coating with 2% by weight to total gelatin of hardner H-1. Surfactants, coating aids, scavengers, soluble absorber dyes and stabilizers were added to the various layers of this sample as is commonly practiced in the art.

Photographic Sample 602 was like Photographic Sample 601 except that 0.59 g of Polymer Latex H was added to layer 10.

Photographic Sample 603 was like Photographic Sample 601 except that 1.07 g of Polymer Latex H was added to layer 10.

Photographic Sample 604 was like Photographic Sample 601 except that 1.99 g of Polymer Latex H was added to layer 10.

Photographic Sample 605 was like Photographic Sample 601 except that 0.59 g of Polymer Latex I was added to layer 10.

Photographic Sample 606 was like Photographic Sample 601 except that 1.07 g of Polymer Latex I was added to layer 10.

Photographic Sample 607 was like Photographic Sample 601 except that 1.99 g of Polymer Latex I was added to layer 10.

Photographic Sample 608 was like Photographic Sample 601 except that 0.59 g of Polymer Latex J was added to layer 10.

Photographic Sample 609 was like Photographic Sample 601 except that 1.07 g of Polymer Latex J was added to layer 10.

Photographic Sample 610 was like Photographic Sample 601 except that 1.99 g of Polymer Latex J was added to layer 10.

Photographic Sample 611 was like Photographic Sample 601 except that 0.59 g of Polymer Latex K was added to layer 10.

Photographic Sample 612 was like Photographic Sample 601 except that 1.07 g of Polymer Latex K was added to layer 10.

Photographic Sample 613 was like Photographic Sample 601 except that 1.99 g of Polymer Latex K was added to layer 10.

Photographic Sample 614 was like Photographic Sample 601 except that 0.59 g of Polymer Latex L was added to layer 10.

Photographic Sample 615 was like Photographic Sample 601 except that 1.07 g of Polymer Latex L was added to layer 10.

Photographic Sample 616 was like Photographic Sample 601 except that 1.99 g of Polymer Latex L was added to layer 10.

PREPARATIVE EXAMPLE 5:—Samples 701 to 704

A color photographic recording material (Photographic Sample 701) for color negative development was prepared by applying the following layers in the given sequence to a transparent support of cellulose triacetate. The quantities of silver halide are given in grams of silver per $m^2$. The quantities of other materials are given in $g/m^2$. All silver halide emulsions were stabilized with 2 grams of 4-hydroxy-6-methyl-1,3,3a,7-tetraazaindene per mole of silver. Compounds M-1, M-2 and D-2 were used as emulsions containing tricresylphosphate. Compounds C-1, C-2, Y-1 and D-3 were used as emulsions containing di-n-butyl phthalate. Compound D-1 was used as an emulsion containing N-n-butyl acetanalide. Compounds UV-1 and UV-2 were used as emulsions containing 1,4-cyclohexylenedimethylene bis-(2-ethoxyhexanoate).

Layer 1 (Antihalation Layer) black colloidal silver sol containing 0.215 g of silver, dye UV-1 at 0.075 g, dye MD-1 at 0.038 g, dye CD-2 at 0.054 g, MM-2 at 0.13 g, scavenger S-1 at 0.16 g with 1.61 g gelatin.

Layer 2 (Interlayer) Oxidized developer scavenger S-1 at 0.11 g and 0.65 g of gelatin.

Layer 3 (First Red-Sensitive Layer) Red sensitized silver iodobromide tabular grain emulsion (3.8 mol % iodide, average grain diameter 0.6 microns) at 0.75 g, cyan dye-forming image coupler C-1 at 0.70 g, DIR compound D-7 at 0.016, cyan dye-forming masking coupler CM-1 at 0.027 g with gelatin at 1.72 g.

Layer 4 (Second Red-Sensitive Layer) Red Sensitized silver iodobromide tabular grain emulsion (4 mol % iodide, average grain diameter 1.3 microns) at 0.97 g, cyan dye-forming image coupler C-2 at 0.14 g, DIR compound D-9 at 0.005 g, DIR compound D-7 at 0.022, cyan dye-forming masking coupler CM-1 at 0.016 g with gelatin at 1.51 g.

Layer 5 (Third Red-Sensitive Layer) Red sensitized silver iodobromide tabular grain emulsion (4 mol % iodide, average grain diameter 2 microns) at 0.97 g, cyan dye-forming image coupler C-2 at 0.13 g, DIR compound D-7 at 0.022 g, cyan dye-forming masking coupler CM-1 at 0.016 g with gelatin at 1.4 g.

Layer 6 (Interlayer) Oxidized developer scavenger S-1 at 0.16 g and 0.65 g of gelatin.

Layer 7 (First Green-Sensitive Layer) Green sensitized silver iodobromide tabular grain emulsion (4 mol % iodide, average grain diameter 0.65 microns) at 0.75 g, magenta dye-forming image coupler M-1 at 0.16 g, magenta dye-forming coupler M-2 at 0.16 g, DIR compound D-4 at 0.018 g, magenta dye-forming masking coupler MM-1 at 0.037 g, with gelatin at 1.51 g.

Layer 8 (Second Green-Sensitive Layer) Green sensitized silver iodobromide tabular grain emulsion (4 mol % iodide, average grain diameter 1.4 microns) at 0.97 g, magenta dye-forming image coupler M-1 at 0.054 g, magenta dye-forming image coupler M-2 at 0.054 g, DIR compound D-4 at 0.022 g, magenta dye-forming masking coupler MM-1 at 0.015 g, with gelatin at 1.67 g.

Layer 9 (Third Green-Sensitive Layer) Green sensitized silver iodobromide tabular grain emulsion (4 mol % iodide, average grain diameter 1.7 microns) at 0.97 g, magenta dye-forming image coupler M-1 at 0.038 g, magenta dye-forming image coupler M-2 at 0.038 g, magenta dye-forming masking coupler MM-1 at 0.011 g, DIR compound D-4 at 0.012 g, with gelatin at 1.4 g.

Layer 10 (Interlayer) Oxidized developer scavenger S-1 at 0.16 g, dye YD-2 at 0.13 g with 1.08 g of gelatin.

Layer 11 (First Blue-Sensitive Layer) Blue Sensitized silver iodobromide tabular grain emulsion (3.6 mol % iodide, average grain diameter 0.9 microns, at 0.43 g, blue sensitized silver iodobromide tabular grain emulsion (3.8 mol % iodide, average grain diameter 1.5 microns) at 0.27 g, yellow dye-forming image coupler Y-2 at 1.08 g, DIR compound D-3 at 0.032 g, compound B-2 at 0.032 g with gelatin at 2.47 g.

Layer 12 (Second Blue-Sensitive Layer) Blue sensitized silver iodobromide tabular grain emulsion (3 mol % iodide, average grain diameter 3.3 microns, at 0.75 g, yellow dye-forming image coupler Y-2 at 0.22 g, DIR compound D-3 at 0.032 g, with gelatin at 1.72 g.

Layer 13 (Protective Layer 1) 0.108 g of dye UV-1, 0.118 g of dye UV-2, unsensitized silver bromide Lippman emulsion at 0.108 g, with gelatin at 1.08 g.

Layer 14 (Protective Layer 2) Anti-matte polymethylmethacrylate beads at 0.0538 g with gelatin at 0.75 g.

This film was hardened at coating with 2% by weight to total gelatin of conventional hardner H-1 (bis(vinylsulfonyl) methane). Surfactants, coating aids, scavengers, soluble absorber dyes and stabilizers were added to the various layers of this sample as is commonly practiced in the art.

Photographic Sample 702 was like Photographic Sample 701 except that 1.29 g of Polymer Latex A and 0.11 g of Polymer Latex C were both added to layer 11.

Photographic Sample 703 was like Photographic Sample 701 except that 1.29 g of Polymer Latex A and 0.11 g of Polymer Latex C were both added to layer 13.

Photographic Sample 704 was like Photographic Sample 701 except that 1.29 g of Polymer Latex A and 0.11 g of Polymer Latex C were both added to layer 10.

PREPARATIVE EXAMPLE 6:—Samples 801 to 806

Photographic Sample 801 was prepared like Photographic Sample 101 by applying the following layers in the given sequence to a transparent support of cellulose triacetate.

Layer 1 (Antihalation Layer) black colloidal silver sol containing 0.323 g of silver, dye UV-1 at 0.075 g, dye MD-1 at 0.016 g, dye CD-2 at 0.027 g, MM-2 at 0.17 g with 2.44 g gelatin.

Layer 2 (First Red-Sensitive Layer) Red sensitized silver iodobromide tabular grain emulsion (4 mol % iodide, average grain diameter 0.8 microns) at 0.27 g, red sensitized silver iodobromide emulsion (4 mol % iodide, average grain diameter 1.3 microns, average grain thickness 0.1 micron) at 0.16 g, cyan dye-forming image coupler C-2 at 0.48 g, DIR compound D-1 at 0.003 g, DIR compound D-7 at 0.011 BAR compound B-1 at 0.032 g, with gelatin at 1.61 g.

Layer 3 (Second Red-Sensitive Layer) Red sensitized silver iodobromide tabular grain emulsion (4.2 mol % iodide, average grain diameter 2.1 microns) at 0.48 g, cyan dye-forming image coupler C-2 at 0.17 g, DIR compound D-7 at 0.011 g, DIR compound D-1 at 0.007 g BAR compound B-1 at 0.011 g, cyan dye-forming masking coupler CM-1 at 0.032 g with gelatin at 1.29 g.

Layer 4 (Interlayer) Oxidized developer scavenger S-1 at 0.054 g and 1.61 g of gelatin.

Layer 5 (Interlayer) Oxidized developer scavenger S-1 at 0.108 g and 1.08 g of gelatin.

Layer 6 (Green-Sensitive Layer) Green sensitized silver iodobromide tabular grain emulsion (4 mol % iodide, average grain diameter 0.65 microns) at 0.32 g, green sensitized silver iodobromide emulsion (4 mol % iodide, average grain diameter 1.5 microns, average thickness 0.09 microns) at 0.32 g, green sensitized silver iodobromide emulsion (4.2 mol % iodide, average grain diameter 2.3 microns, average grain thickness 0.09 microns) at 0.44 g, magenta dye-forming image coupler M-1 at 0.16 g, magenta dye forming image coupler M-2 at 0.27 g, DIR compound D-1 at 0.015 g, DIR compound D-2 at 0.009 g, magenta dye-forming masking coupler MM-1 at 0.037 g, with gelatin at 2.69 g.

Layer 7 (Interlayer) Oxidized developer scavenger S-1 at 0.108 g, yellow colloidal silver at 0.038 g with 1.08 g of gelatin.

Layer 8 (Blue-Sensitive Layer) Blue sensitized silver iodobromide emulsion tabular grain (4 mol % iodide, average grain diameter 0.9 microns) at 0.33 g, blue sensitized silver iodobromide emulsion (4 mol % iodide, average grain diameter 1.5 microns, average grain thickness 0.09 micron) at 0.22 g, blue sensitized silver iodobromide emulsion (3 mol % iodide, average grain diameter 3.3 microns, average grain thickness 0.12 microns) at 0.75 g, yellow dye-forming image coupler Y-1 at 0.86 g, DIR compound D-3 at 0.053 g, compound B-2 at 0.022 g with gelatin at 2.15 g.

Layer 9 (Protective Layer) at 0.108 g of dye UV-1, 0.118 g of dye UV-2, unsensitized silver bromide Lippman emulsion at 0.108 g, anti-matte polymethylmethacrylate beads at 0.0538 g with gelatin at 1.6 g.

This film was hardened at coating with 2% by weight to total gelatin of hardener H-1. Surfactants, coating aids, scavengers, soluble absorber dyes and stabilizers were added to the various layers of this sample as is commonly practiced in the art.

Photographic Sample 802 was like Photographic Sample 801 except that 0.81 g of Polymer Latex A was added to each of layers 6 and 8.

Photographic Sample 803 was like Photographic Sample 801 except that 1.61 g of Polymer Latex A was added to layer 9.

Photographic Sample 804 was like Photographic Sample 801 except that 0.81 g of Polymer Latex A was added to each of layers 7 and 9.

Photographic Sample 805 was like Photographic Sample 801 except that 1.61 g of Polymer Latex A was added to layer 7.

Photographic Sample 806 was like Photographic Sample 801 except that 1.61 g of polymer latex A was added to layer 5.

Polymeric latexes employed in Preparative Examples 1 through 6 are described below. Component monomers, relative proportions and polymer Tg in degrees Centigrade are listed.

Polymer Latex A: n-Butyl acrylate/2-acrylamido-2-methylpropane sulfonic acid/2-acetoacetoxyethyl methacrylate—(88:5:7)—Tg=−28° C.

Polymer Latex B: Methyl Acrylate/2-acrylamido-2-methylpropane sulfonic acid—(96:4)—Tg=+9.5° C.

Polymer Latex C: Methyl Acrylate/2-acrylamido-2-methylpropane sulfonic acid/2-acetoacetoxyethyl methacrylate—(91:5:4)—Tg=+10.5° C.

Polymer Latex D: n-Butyl acrylate/styrene/methyacrylamide/2-acrylamido-2-methylpropane sulfonic acid—(59:25:8:8)—Tg=−9.5° C.

Polymer Latex E: 2-Ethylhexyl acrylate/2-acrylamido-2-methylpropane sulfonic acid—(95:5)—Tg=−50° C.

Polymer Latex F: n-Butyl acrylate/Methacrylic acid—(95:5)—Tg=−43° C. as a gel-grafted latex.

Polymer Latex G: n-Butly acrylate/Methacrylic acid—(95:5)—Tg=−43° C. as a case-hardened gel-grafted latex.

Polymer Latex H: n-Butyl acrylate/2-acrylamido-2-methylpropane sulfonic acid—(95:5)—Tg=−43° C.

Polymer Latex I: n-Butyl acrylate/styrene/2-acrylamido-2-methylpropane sulfonic acid—(85:10:5)—Tg=−32° C.

Polymer Latex J: n-Butyl acrylate/styrene/2-acrylamido-2-methylpropane sulfonic acid—(75:20:5)—Tg=−28° C.

Polymer Latex K: n-Butyl acrylate/styrene/2-acrylamido-2-methylpropane sulfonic acid—(65:30:5)—Tg=−14° C.

Polymer Latex L: n-Butyl acrylate/styrene/2-acrylamido-2-methylpropane sulfonic acid—(55:40:5)—Tg=+1° C.

ILLUSTRATIVE EXAMPLE 7:

The total color saturation of Photographic Samples 101 through 616 was tested by exposing a portion of each sample to either white light, or red light using a KODAK Wratten 29 filter, or green light using a KODAK Wratten 74 filter, or blue light using a KODAK Wratten 98 filter through a grey wedge chart. These samples were then developed using a color negative process, the KODAK C-41 process, as described in the British Journal of Photography Annual of 1988, pp. 196–198 (KODAK is a trademark of the Eastman Kodak Company, U.S.A.)

The red, green and blue Status M density of each portion of each sample thus exposed and processed was determined as a function of exposure level and the color separation gamma and neutral gamma response of each Photographic Sample was calculated. Gamma is the change in density produced as a function of exposure level.

The ratio of the red gamma after a red light exposure divided by the red gamma after a white light exposure is a measure of the degree of color saturation that can be reproduced in photographs of red colored objects. Likewise, the ratio of the green gamma after a green light exposure divided by the green gamma after a white light exposure is a measure of the degree of color saturation that can be reproduced in photographs of green colored objects. In a similar vein, the ratio of the blue gamma after a blue light exposure divided by the blue gamma after a white light exposure is a measure of the degree of color saturation that can be reproduced in photographs of blue colored objects. In each case, a larger ratio indicates a greater degree of color saturation.

For convenience, the three individual color saturation ratios thus determined for each sample are averaged to give a single number which may be used to estimate the gross color saturation (CS) available using the sample. The samples may be intercompared either on the basis of the color saturation value evaluated as described above or on the basis of the percent change in color saturation value relative to some check position. The percent change in color saturation value may be more predictive of the appearance of a picture prepared using the photographic sample. The percent change in color saturation is calculated as:

$$\frac{(CS)\text{sample} - (CS)\text{control}}{(CS)\text{control}} \times 100$$

Here positive values indicate an increase in color saturation for the sample relative to the control while negative values indicate a decrease in color saturation for the sample relative to the control. Table VI lists the color saturation and percent change in color saturation for determined for Photographic Samples 101 through 616.

Also listed is the identity, quantity, and Tg of the Polymer latex used as well as the proportion of Polymer latex incorporated in the protective layer. This proportion is calculated as:

$$\frac{\text{weight of polymer latex}}{\text{weight of polymer latex + gelatin}} \times 100$$

TABLE VI

Color Saturation of Photographic Samples.

| Sample | Polymer Latex Added | | | | Color Saturation | Percent Change in Color Saturation |
|---|---|---|---|---|---|---|
| | Identity | Quantity | Tg | % Added | | |
| 101 (control) | none | 0.0 | — | 0.0% | 1.24 | 0 |
| 102 | A | 0.59 | −28 | 57.9% | 1.25 | 0.8 |
| 103 | A | 1.07 | −28 | 66.7% | 1.28 | 3.2 |

TABLE VI-continued

Color Saturation of Photographic Samples.

| Sample | Polymer Latex Added Identity | Quantity | Tg | % Added | Color Saturation | Percent Change in Color Saturation |
|---|---|---|---|---|---|---|
| 104 | A | 1.99 | −28 | 78.7% | 1.30 | 4.8 |
| 105 (control) | TCP | 0.59 | — | 57.9% | 1.24 | 0 |
| 106 (control) | TCP | 1.07 | — | 66.7% | 1.23 | −0.8 |
| 107 | D | 0.59 | −9.5 | 57.9% | 1.27 | 2.4 |
| 108 | D | 1.07 | −9.5 | 66.7% | 1.32 | 6.5 |
| 109 | D | 1.99 | −9.5 | 78.7% | 1.34 | 8.1 |
| 110 | C | 1.99 | +10.5 | 78.7% | 1.29 | 4.0 |
| 201 (control) | none | 0.0 | — | 0.0% | 1.24 | 0 |
| 202 | A | 0.59 | −28 | 31.4% | 1.28 | 3.2 |
| 203 | A | 1.07 | −28 | 45.5% | 1.30 | 4.8 |
| 204 | A | 1.99 | −28 | 60.6% | 1.31 | 5.6 |
| 205 (control) | TCP | 1.07 | — | 45.5% | 1.23 | −0.8 |
| 206 (control) | TCP | 1.99 | — | 60.6% | 1.24 | 0 |
| 207 | D | 0.59 | −9.5 | 31.4% | 1.28 | 3.2 |
| 208 | D | 1.07 | −9.5 | 45.5% | 1.30 | 4.8 |
| 209 | D | 1.99 | −9.5 | 60.6% | 1.29 | 4.0 |
| 210 | C | 1.99 | +10.5 | 60.6% | 1.27 | 2.4 |
| 301 (control) | none | 0.0 | — | 0.0% | 1.17 | 0 |
| 302 | A | 2.15 | −28 | 80.8% | 1.28 | 9.4 |
| 303 | A | 1.07 | −28 | 66.7% | 1.20 | 2.6 |
| 304 | C | 2.15 | +10.5 | 80.0% | 1.18 | 0.9 |
| 305 | C | 1.07 | +10.5 | 66.7% | 1.23 | 5.1 |
| 306 | D | 1.58 | −9.5 | 74.6% | 1.25 | 6.8 |
| 307 | D | 0.79 | −9.5 | 59.4% | 1.22 | 4.3 |
| 308 | B | 2.15 | +9.5 | 80.0% | 1.21 | 3.4 |
| 309 | B | 1.07 | +9.5 | 66.7% | 1.19 | 1.7 |
| 310 | A | 2.15 | −28 | 80.0% | 1.24 | 6.0 |
| 311 | F | 1.07 | −43 | 66.7% | 1.14 | −2.6 |
| 312 | F | 0.59 | −43 | 52.0% | 1.12 | −4.3 |
| 401 (control) | none | 0.0 | — | 0.0% | 1.42 | 0 |
| 402 (control) | TCP | 2.15 | — | 69.0% | 1.34 | −5.6 |
| 403 | E | 2.15 | −50 | 69.0% | 1.40 | −1.4 |
| 404 (control) | F | 1.07 | −43 | 52.6% | 1.34 | −5.6 |
| 405 (control) | G | 1.43 | −43 | 59.6% | 1.34 | −5.6 |
| 406 | A | 2.15 | −28 | 69.0% | 1.42 | 0 |
| 601 (control) | none | 0.0 | — | 0.0% | 1.27 | 0 |
| 602 | H | 0.59 | −43 | 52.4% | 1.33 | 4.7 |
| 603 | H | 1.07 | −43 | 66.7% | 1.34 | 5.5 |
| 604 | H | 1.99 | −43 | 79.7% | 1.36 | 7.1 |
| 605 | I | 0.59 | −32 | 52.4% | 1.30 | 2.4 |
| 606 | I | 1.07 | −32 | 66.7% | 1.35 | 6.3 |
| 607 | I | 1.99 | −32 | 79.7% | 1.37 | 7.9 |
| 608 | J | 0.59 | −28 | 52.4% | 1.33 | 4.7 |
| 609 | J | 1.07 | −28 | 66.7% | 1.32 | 3.9 |
| 610 | J | 1.99 | −28 | 79.7% | 1.33 | 4.7 |
| 611 | K | 0.59 | −14 | 52.4% | 1.34 | 5.5 |
| 612 | K | 1.07 | −14 | 66.7% | 1.33 | 4.7 |
| 613 | K | 1.99 | −14 | 79.7% | 1.32 | 3.9 |
| 614 | L | 0.59 | +1 | 52.4% | 1.30 | 2.4 |
| 615 | L | 1.07 | +1 | 66.7% | 1.31 | 3.1 |
| 616 | L | 1.99 | +1 | 79.7% | 1.34 | 5.5 |

TCP is tricresyl phosphate

Photographic Samples 101 through 616 all incorporate the anionic polymer latex in a layer positioned further from the support than any light sensitive layer. Within each set there is a sample which does not include an anionic polymer latex. This sample is the control sample for each set.

Photographic Samples 101 through 110 illustrates that the degree of color saturation is controlled by the quantity of anionic polymer latex dispersion added to the sample and that the Tg of the anionic polymer latex is not a controlling factor. Photographic Samples 105 and 106 incorporate dispersions of tricresylphosphate (TCP). The behavior of these samples indicates that merely incorporating a hydrophobic component in place of the anionic polymer latex has no influence on color saturation.

Photographic Samples 201 through 210 are like samples 101 through 110 except that the quantity of gelatin in layer 10 was greatly increased. These samples illustrate that merely incorporating additional gelatin in place of the polymer latex has no effect on color saturation.

Photographic Samples 301 through 312 illustrate the efficacy of the anionic polymer latexes at improving color saturation in photographic materials employing a distinct set of DIR compounds. Samples 311 and 312 which incorporate a latex polymer (F) which has been gel-grafted as described in U.S. Pat. No. 4,855,219 is ineffective as improving color saturation.

Photographic Samples 401 through 406 illustrate the effect of simultaneously lowering DIR level and incorporating an anionic polymer latex dispersion. Samples 403 and 406 which incorporate the inventive combination of a DIR compound and anionic polymer latex illustrate that the quantity of DIR compound can be reduced without greatly altering the level of color saturation according to this invention. Sample 402, which incorporates a dispersion of tricresyl phosphate (TCP) again illustrates that merely incorporating a hydrophobic organic component has no effect on improving color saturation. Samples 404 and 405 which incorporate gel-grafted polymer latexes E & F (see U.S. Pat. Nos. 4,855,219 and 4,920,004) again illustrate that an insulated anionic polymer latex had no influence on the degree of color saturation attainable.

Photographic Samples 601 through 616 illustrate the efficacy of yet another series of polymer latexes at improving the color saturation in photographic samples that employ other DIR compounds at other levels.

ILLUSTRATIVE EXAMPLE 8

Photographic Samples 701 through 704 were exposed, processed and analyzed as described for Samples 101 through 616. The color saturation attainable with these samples is listed in Table VII.

TABLE VII

| | Latex Component Added | | | Color | Percent Increase in Color |
|---|---|---|---|---|---|
| Sample | Layer | Identity | Quantity | Saturation | Saturation |
| 701 C | — | — | 0.0 | 1.32 | 0 |
| 702 C | 11 | A + C | 1.4 | 1.19 | −9.8 |
| 703 | 13 | A + C | 1.4 | 1.37 | 3.8 |
| 704 | 10 | A + C | 1.4 | 1.40 | 6.1 |

As can be readily appreciated on examination of the experimental data presented in Table VII, the samples incorporating the mixtures of anionic polymer latexes (samples 703 and 704) enable increased color saturation when incorporated in an interlayer. Sample illustrates that incorporation of the anionic polymer latex in an emulsion layer (as described in U.S. Pat. No. 5,015,566) greatly decreases the available color saturation.

ILLUSTRATIVE EXAMPLE 9

Photographic Samples 801 through 806 were exposed, processed and analyzed as described for Samples 101 through 616. The color saturation attainable with these samples is listed in Table VIII.

TABLE VIII

| | Latex Component Added | | | Color | Percent Increase in Color |
|---|---|---|---|---|---|
| Sample | Layer | Identity | Quantity | Saturation | Saturation |
| 801 C | — | — | 0.0 | 1.39 | 0 |
| 802 C | 6 & 8 | A | 1.6 | 1.28 | −7.9 |
| 803 | 9 | A | 1.6 | 1.47 | 5.8 |
| 804 | 7 & 9 | A | 1.6 | 1.44 | 3.6 |
| 805 | 7 | A | 1.6 | 1.41 | 1.4 |
| 806 C | 5 | A | 1.6 | 1.37 | −1.4 |

As can be readily appreciated on examination of the experimental data presented in Table VIII, the samples incorporating anionic polymer latexes in an interlayer (Samples 803, 804 and 805) enable increased color saturation. Sample 802 again illustrates that incorporation of the anionic polymer latex in an emulsion layer (as described in U.S. Pat. No. 5,015,566) greatly decreases the available color saturation. Sample 806 illustrates that when there are silver halide emulsion layers sensitive to only one region of the spectrum between the layer incorporating the anionic polymer latex and the support, that no increase in color saturation is attained.

The invention has been described in detail with particular reference to preferred embodiments thereof, but it will be understood that variations and modifications can be effected within the spirit and scope of the invention.

I claim:

1. A color photographic element comprising a support, a first and a second silver halide emulsion layer each sensitized to a different region of the spectrum, at least one of the emulsion layers being in reactive association with a DIR compound which releases an anionic development inhibitor, and a barrier layer comprising an anionic latex polymer such that the barrier layer reflects the development inhibitor released from the DIR compound, the barrier layer being positioned further from the support than the first and second silver halide emulsion layers.

2. The photographic element of claim 1 wherein the polymer is derived from ethylenically unsaturated monomers.

3. The photographic element of claim 1 wherein the polymer is derived from repeating units with 1 to 20% by weight of the repeating units containing an anionic pendant group.

4. A color photographic element comprising a support, a first and a second silver halide emulsion layer each sensitized to a different region of the spectrum, at least one of the emulsion layers being in reactive association with a DIR compound which releases an anionic development inhibitor, and a barrier layer comprising a latex anionic polymer comprised of repeating units derived from non-polar acrylate or methacrylate monomers and repeating units derived from vinyl monomers having an anionic pendant group with at least 1% by weight of all of the repeating units containing an anionic pendant group such that the barrier layer reflects the development inhibitor released from the DIR compound, the barrier layer being positioned further from the support than the first and second silver halide emulsion layer.

5. The color photographic element of claim 4 wherein the latex anionic polymer is comprised of repeating units of the formula $$-(A)_m-(B)_n-$$

wherein:

A is a repeating unit derived from the non-polar monomer having the structure

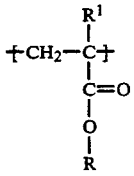

where $R^1$ is a —H or $—CH_3$ m is 1 to 99 mole %;

R is an ester forming moiety containing 1 to 18 carbon atoms; and where

B is a repeating unit derived from a monomer having the structure

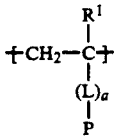

where $R^1$ is —H or —$CH_3$

L is a divalent linking group;

a is 1 or 0;

P is a anionic pendant group; and n is 1 to 99 mole %.

6. The photographic element of claim 5 wherein $R^1$ of repeating unit A is —H, and R of repeating unit A is an ester moiety comprising a straight or branched alkyl group of 2 to 10 carbon atoms, an aromatic group of 7 to 10 carbon atoms, a cycloalkyl group of from 3 to 10 carbon atoms, or a mono-oxy, di-oxy or tri-oxy ether containing from 2 to 10 carbon atoms; and wherein B is a repeating unit derived from the monomer having the structure

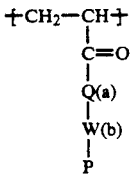

where

Q is —O— or —NH—;

a is 1 or 0;

W is a straight, branched or cyclic alkylene group of 3 to 10 carbons;

b is 1 or 0; and

P is an anionic pendant group.

7. The photographic element of claim 6 wherein P is selected from the group consisting of —$CO_2M$, —$SO_3M$, and —$OSO_3M$ and M is a cation.

8. The photographic element of claim 6 wherein A is derived from a monomer selected from the group consisting of n-butyl acrylate, methyl acrylate, and 2-ethylhexyl acrylate and wherein B is selected from the group consisting of 2-acrylamido-2-methylpropane sulfonic acid and methacrylic acid.

9. The photographic element of claims 4, 5, 6, or 7 wherein 1 to 20% by weight of the repeating units contain anionic pendant groups.

10. The photographic element of claim 9 wherein 4 to 8% by weight of the repeating units contain anionic pendant groups.

11. A method of developing any one of the photographic elements described in claims 1, 4, 5 or 6 wherein the photographic element is developed with a developing agent.

12. A method of developing the photographic element described in claim 9 wherein the photographic element is developed with a developing agent.

* * * * *